US012644660B2

(12) United States Patent
Sunseri

(10) Patent No.: US 12,644,660 B2
(45) Date of Patent: Jun. 2, 2026

(54) RIFLE WITH STRAIGHT PULL BOLT ACTION

(71) Applicant: Savage Arms, Inc., Westfield, MA (US)

(72) Inventor: Andrew G. Sunseri, West Springfield, MA (US)

(73) Assignee: Savage Arms, Inc., Westfield, MA (US)

( * ) Notice: Subject to any disclaimer, the term of this patent is extended or adjusted under 35 U.S.C. 154(b) by 55 days.

(21) Appl. No.: 18/767,624

(22) Filed: Jul. 9, 2024

(65) Prior Publication Data

US 2026/0055978 A1 Feb. 26, 2026

Related U.S. Application Data

(63) Continuation of application No. 17/567,838, filed on Jan. 3, 2022, now Pat. No. 12,031,788, which is a continuation-in-part of application No. PCT/US2020/040792, filed on Jul. 2, 2020.

(60) Provisional application No. 62/870,017, filed on Jul. 2, 2019.

(51) Int. Cl.
*F41A 3/20* (2006.01)

(52) U.S. Cl.
CPC ..... *F41A 3/20* (2013.01)

(58) Field of Classification Search
CPC ..... F41A 3/20; F41A 3/12; F41A 3/14; F41A 3/16; F41A 3/18
USPC ..... 42/14, 16
See application file for complete search history.

(56) References Cited

U.S. PATENT DOCUMENTS

| | | | |
|---|---|---|---|
| 1,044,780 | A | 11/1912 | Grant |
| 1,568,635 | A | 1/1926 | William |
| 2,277,959 | A | 3/1942 | Cullon |
| 3,234,679 | A | 2/1966 | Benson |
| 3,257,749 | A | 6/1966 | Donaldson |
| 3,341,963 | A | 9/1967 | Seiderman |
| 3,653,140 | A | 4/1972 | Alday |
| 3,791,062 | A | 2/1974 | Martial |

(Continued)

FOREIGN PATENT DOCUMENTS

| | | | |
|---|---|---|---|
| AT | 14107 | U1 | 4/2015 |
| DE | 2418915 | A1 | 10/1975 |

(Continued)

*Primary Examiner* — John Cooper
(74) *Attorney, Agent, or Firm* — Christensen, Fonder, Dardi & Busse PLLC; Timothy J. Busse; Douglas J. Christensen

(57) ABSTRACT

A rifle having a straight pull bolt assembly with a bolt handle that extends outward and downward from a bolt operation mechanism. The bolt handle rotatable a limited rotational range forward and rearwardly about a horizontal axis for operating the mechanism. The handle can be reconfigured to position its rotational range about the horizontal axis and can be attached to the mechanism at either left or right sides to provide for ambidextrous operation. Bolt heads, lower frame members with magazine wells, and barrel assemblies can be readily swapped to change ammunition. The bolt assembly can be unlocked by firing or by a thumb push button release at the backside of the mechanism. A bolt removal release mechanism is forward of the thumb pushbutton and an ejector includes a spring bias and cam follower surface to reliably eject casings.

17 Claims, 37 Drawing Sheets

(56) References Cited

U.S. PATENT DOCUMENTS

| | | | | |
|---|---|---|---|---|
| 4,358,986 | A | 11/1982 | Giorgio | |
| 4,547,988 | A | 10/1985 | Nilsson | |
| 4,672,762 | A | 6/1987 | Nilsson | |
| 4,922,640 | A | 5/1990 | Toombs | |
| 5,259,137 | A * | 11/1993 | Blenk | F41A 3/42 42/16 |
| 5,447,092 | A * | 9/1995 | Dobbins | F41A 3/46 42/16 |
| 5,722,194 | A | 3/1998 | Franz et al. | |
| 6,393,961 | B1 | 5/2002 | Ockenfuss | |
| 6,553,706 | B1 | 4/2003 | Gancarz et al. | |
| 7,571,671 | B2 * | 8/2009 | Engel | F41A 5/16 89/174 |
| 7,770,507 | B1 * | 8/2010 | Hajjar | F41A 3/46 89/188 |
| 9,115,941 | B2 | 8/2015 | Tertin et al. | |
| 9,513,076 | B2 | 12/2016 | Kolev et al. | |
| 9,599,417 | B2 | 3/2017 | Kolev et al. | |
| 9,810,496 | B2 | 11/2017 | Kolev et al. | |
| 10,077,957 | B1 * | 9/2018 | Aguf | F41A 3/72 |
| 10,151,544 | B1 | 12/2018 | Sugg | |
| 10,247,500 | B2 | 4/2019 | Owens et al. | |
| 10,690,440 | B2 | 6/2020 | Coburn et al. | |
| 2010/0281733 | A1 | 11/2010 | Constant et al. | |
| 2012/0047786 | A1 * | 3/2012 | Dextraze | F41C 23/04 42/71.01 |
| 2014/0013641 | A1 | 1/2014 | Warburton et al. | |
| 2014/0059910 | A1 | 3/2014 | Norton et al. | |
| 2015/0233656 | A1 | 8/2015 | Karagias | |
| 2016/0252316 | A1 * | 9/2016 | Garrow | F41A 19/30 89/181 |
| 2018/0100714 | A1 | 4/2018 | Borders | |
| 2020/0049436 | A1 * | 2/2020 | Braceras Devecchi | F41A 19/34 |
| 2022/0003512 | A1 * | 1/2022 | Underwood | F41A 3/62 |
| 2022/0099391 | A1 | 3/2022 | Koehler et al. | |
| 2022/0276020 | A1 * | 9/2022 | Sullivan | F41B 11/721 |
| 2023/0123825 | A1 | 4/2023 | Zedrosser et al. | |
| 2023/0124825 | A1 | 4/2023 | Plebani et al. | |

FOREIGN PATENT DOCUMENTS

| | | | |
|---|---|---|---|
| DE | 102012217686 | A1 | 4/2014 |
| EP | 0163912 | A1 | 12/1985 |
| GB | 778083 | A | 7/1957 |
| WO | 2007101292 | A1 | 9/2007 |
| WO | 2014031410 | A1 | 2/2014 |
| WO | 2018065642 | A1 | 4/2018 |
| WO | 2021040887 | A1 | 3/2021 |

* cited by examiner

RIFLE WITH STRAIGHT PULL BOLT ACTION

RELATED APPLICATIONS

This application is a continuation application of U.S. Non-Provisional application Ser. No. 17/567,838, filed Jan. 3, 2022, now U.S. Pat. No. 12,031,788, which is a continuation-in-part of PCT/US2020/040792 filed Jul. 2, 2020, which claims priority to U.S. Provisional Application 62/870,017 filed Jul. 2, 2019. Said applications are incorporated by reference herein in their entireties.

BACKGROUND OF THE INVENTION

The conventional four motion bolt action is the most common manually operated cycling mechanism used in rifles. During the initial firing of the cartridge, the bolt is locked at an in-battery position. After firing, the bolt action handle is raised upwardly rotating the bolt about the barrel axis to unlock the bolt and is then pulled rearwardly. As the bolt moves rearward the fired empty cartridge is extracted from the firing chamber. After the spent cartridge is ejected, the bolt is moved forward, by the bolt handle, engaging the next cartridge in the magazine and pushing that cartridge into the chamber. The bolt handle is then rotated downwardly locking the bolt in the in-battery firing position. The torque required to lock and unlock the bolt assembly, by raising and lowering the bolt handle is not insignificant and can cause rotational movement of the firearm and generally move the firearm off of its target, requiring re-sighting.

Straight pull rifles reduce the number of motions to essentially two motions for cycling the firearm. The locking of the bolt head into the barrel or barrel extension is by means other than the user rotating the bolt action handle about the barrel axis. In that the two upward and downward motions of the bolt handle are not needed there is more stability in holding the firearm.

Thus, straight pull rifle actions are generally mechanically more complicated that four motion bolt action rifles and are typically much more expensive. The increased mechanical complexity applies to the bolt operational mechanisms, operational controls, firearm disassembly steps, and convertibility to different calibers and cartridges where available. Bolt removal releases and bolt unlock controls often are not intuitive or readily accessed. Generally, straight pull rifles, like conventional four motion bolt action rifles are not convertible from right to left handed operation of the bolt. Any new improvements in straight pull rifles that improve on speed of operation, ergonomics, ease in finding the operational controls, convertibility from right to left handed use and vice versa, flexibility in changing calibers, less complexity in making modifications, particularly with no tools or minimal tools, and providing a robust action that can be manufactured for less than competitive straight pull rifles, would be welcomed in the marketplace.

SUMMARY OF THE INVENTION

A straight pull bolt action rifle comprises a bolt assembly mounted in a receiver, in a stock, with a trigger mechanism positioned below the bolt assembly, a barrel and barrel extension secured forward of the receiver to receive a bolt head of the bolt assembly. Locking of the bolt action in the ready-to-fire position is by way of a short rotation forward in an arcuate path about a horizontal axis of the bolt handle that is a continuation of the forward linear motion of the bolt assembly and bolt handle in chambering a cartridge. Unlocking of the bolt action after firing or to eject a cartridge utilizes a short opposite rotation of the bolt handle in an arcuate path about a horizontal axis and then the rearward linear motion of the bolt assembly including the bolt handle. The minimal arcuate paths of the bolt handle motion rearwardly combined with the linear motion of the bolt body sliding in the receiver is such that the overall motions, including the arcuate motions, are appropriately termed straight.

In embodiments, enhanced ergonomics is provided by the bolt handle being readily swappable between the left and right sides of the bolt assembly and by being angularly adjustable on each side. Further enhanced ergonomics being provided by one or more of a thumb pushbutton for unlocking the bolt handle and bolt when in the in-battery ready-to-fire position, the thumb button within reach by the user's hand while grasping the bolt handle, an ambidextrous tang safety is positioned directly below and behind the bolt assembly, and a bolt assembly pull-out release lever is directly forward of the rotation axis of the bolt handle on the receiver for removal of the bolt.

The bolt assembly comprising a bolt carrier containing a bolt body, a bolt head, a bolt plunger, a striker, a firing pin, a firing pin spring, a rear bolt enclosure, a bolt operation mechanism, and the bolt handle connecting to the bolt operation mechanism at the rear bolt enclosure. In embodiments, the bolt head having a plurality of locking roller balls that are releasably engageable with recesses in the barrel extension and lockable therein by the bolt plunger.

A feature and advantage of embodiments is a rifle having a straight pull bolt action with improved ergonomics and functionality. The straight pull bolt action eliminates two of the four motions required to cycle a rifle compared to a traditional four motion bolt action resulting in faster ejection and loading as well as more gun stability during the cycling, less re-aiming, and improved accuracy in shooting.

In embodiments, functional operation and control of the straight pull rifle action is through the bolt operation mechanism in an enclosure at the rearward end of the bolt assembly configured as a bolt assembly cap. The bolt operation mechanism providing for all or some of the following functions: locking the bolt in the in-battery position, providing the final locking of the bolt with a plunger a gradual final locking, unlocking the bolt from the in-battery position manually or upon firing, manually unlocking the bolt at the in-battery position at a gradual reduced travel rate, locking the bolt handle forwardly, releasing the forward locked bolt handle manually, releasing the forward locked bolt handle by pulling the trigger, providing a manual gradual initial push off of the bolt assembly from the receiver at the closed most forwardly position of the bolt assembly after firing or after a manual bolt handle release, locking the bolt handle in the rearward rotational position, unlocking the bolt handle from the rearward rotational position, and compressing the firing pin spring utilizing the bolt handle. The gradual locking of the bolt head and gradual unlocking and gradual push-off of the receiver providing smooth operation and less jarring of the rifle in cycling the action. Moreover, no or minimal rotational torque about the longitudinal axis of the rifle is caused by the cycling of the firearm.

A feature and advantage of embodiments is a bolt assembly having a downwardly angled bolt handle extending from a rear end of the bolt assembly on a bolt cap initially positioned and configured like a bolt of a conventional four motion bolt action rifle. The bolt having a rotation axis at the rear bolt cap about a horizontal axis of about 45 degrees, plus or minus 15 degrees. From a forwardly most rotation position of the bolt handle, where the bolt is in-battery and the bolt assembly locked forward, the bolt handle is manually released or automatically released and the bolt handle is rotated rearwardly to the rearwardly most rotation position unlocking the bolt assembly from the receiver and barrel extension. The bolt is then pulled rearwardly sliding the bolt assembly rearwardly, ejecting the spent casing or unfired cartridge, to a rearwardly most bolt assembly position with the bolt handle being rotationally locked in the rearwardly most rotational position. The bolt handle is then pushed forwardly, loading the next cartridge, with no bolt handle rotation, to where the bolt cap engages the receiver, the bolt handle continues to be pushed forward thereby rotating the bolt handle, locking the bolt assembly to the receiver and barrel extension, and locking the bolt handle in the forwardly most rotation position, putting the rifle in a ready-to-fire mode.

A feature and advantage of embodiments is the minimal bolt handle rotation is continuous with the forward and rearward sliding of the bolt assembly but is mostly distinct therefrom. In embodiments, a pushbutton at the rear side of the bolt cap releases the bolt handle when the bolt assembly is locked in the forward most position. The button positioned in close proximity to the bolt handle such that the pushbutton is pushable with the user's thumb while the user's fingers of the same hand are hooked onto the bolt handle. The depression of the pushbutton with the release of the locked bolt handle, and the rearward pulling of the bolt handle and opening of the bolt assembly can be accomplished in one smooth continuous motion. The handle being used as an anchor point providing leverage for the pushing the pushbutton while simultaneously commencing the rearward force to move the bolt handle rearwardly.

In embodiments, select ones or all of the above functions are keyed off of a main rotatable drive member that is connected directly to the bolt handle and that rotates with the bolt handle about a horizontal axis (where the barrel axis is horizontal and the gun is upright). In embodiments, the main rotatable drive member rotatably fixed to the bolt carrier and being part of four separate linkage systems. The rotation about a horizontal axis providing a mechanical advantage in operating several functionalities with a plurality of linkages connected to the main rotatable drive member. The rotation of the main rotatable drive member is limited to a partial rotation, for example, a rotation range of 30 to 80 degrees, forward and rearward. The rotation of the bolt handle effecting the rotation of the main rotatable drive member being a smooth uninterrupted continuation of the linear rearward ejection motion and linear forward loading motion of the bolt assembly effected by the bolt handle.

A first linkage system is a sliding toggle mechanism with a first link being the main rotatable drive member, the second link pinned to the main rotatable drive member at an outward first arm of the main rotatable drive member and connecting to a slider at the other end, the slider being the bolt plunger. The first and second links being constrained within the bolt assembly and having an over center position of the pivots that correspond to the bolt plunger being extended and holding the locking roller balls into engagement with the barrel extension thereby locking the bolt head in the in-battery position. The second link also having cam surfaces thereon that receive a bias inward toward the first link by a spring member that maintains the over center position of the linkage. The first linkage system for locking and releasing the bolt in the in-battery position and providing the reduced travel rate for said locking and releasing; for locking the bolt handle in the rearward most position.

A second linkage system is a toggle slider linkage with a second arm of the main rotatable drive member defining a first link, a second link pinned to the first link, a third link pinned to the second link. The second and think links slidingly constrained at the upper wall of the mechanism housing, the upper wall providing a cam surface. The third link having a catch portion for engagement with a catch surface on the receiver and being spring loaded to follow the cam surface of the mechanism housing and for catching the catch surface on the receiver. The second linkage system providing a gradual push off and separation of the rearward end of the bolt assembly from the receiver for initiating the ejection cycle, and for keeping the bolt in a closed position when the bolt is in the in-battery position.

A third linkage system is a cam and two link system for compressing the firing pin spring in preparation for firing, utilizing rotation of the bolt handle. The cam is provided by a surface on the main rotatable drive member, in embodiments the cam surface is on the first arm that is also a link in the first linkage system. The rotation of the main rotatable drive member, rotatably fixed to the bolt body, provides a cam surface that pushes a first link (the striker) rearwardly, the striker pinned to the firing pin such that as the striker and firing pin are pulled rearwardly within the bolt body the firing pin spring is compressed, the firing pin spring having a rearward end anchored to the bolt body. The striker is subsequently engaged by the sear to hold the firing pin spring in the compressed state.

A fourth linkage system is a catch and release mechanism for locking the handle forwardly when the bolt is in the in-battery ready-to-fire position and for providing a push button release button accessible by the thumb for releasing the bolt handle from said position. The main rotatable member providing a handle lock projection. A lever (the thumb pushbutton) is pivotal on the mechanism housing and is pinned to a push button actuation link, the push button actuation link having a cam follower surface that is engaged by a cam surface on the rearward end of the striker, such that as the striker is pulled back by way of the third linkage, the push button actuation link causes a lower end of the thumb pushbutton lever to move towards the main rotatable member to catch and secure the handle lock projection, locking the rotation of the rotatable member in place, thereby locking the bolt handle in the forwardly most position of the bolt handle.

In embodiments, the rifle retains the advantages of a rotating bolt handle, for example, the locking and unlocking of the bolt assembly, but with a downwardly bolt handle, and with a rotation motion that is a continuation or commencement of the linear pull back or forward push during cycling of the bolt action. In embodiments, the rotation range of the bolt handle can be from 90 degrees to 20 degrees. In embodiments, the straight pull bolt action providing for faster, smoother, and more reliable reloading of consecutive cartridges than conventional bolt actions or other straight pull actions.

A feature and advantage of embodiments is a rifle having a straight pull bolt action including a repositionable bolt handle that can be reposition on both the left and right sides of the bolt for ambidextrous operation of the straight pull bolt action. In embodiments an ambidextrous tang safety is provided directly behind and below the rearward end of the bolt assembly.

A feature and advantage of embodiments is a rifle having a straight pull bolt action including a repositionable bolt handle that can be repositioned at different angles from horizontal for ergonomic operation of the straight pull bolt action.

A feature and advantage of embodiments is a rifle having a straight pull bolt action including a detachable bolt handle that can be removed quickly and easily without tools. In embodiments, removal of the bolt handle renders the firearm inoperable for security and safe storage of firearm. In embodiments, a removable handle is provided to secure firearm and to prevent unintended use of the firearm.

A feature and advantage of embodiments is a rifle having a straight pull bolt action including a linkage designed to use leverage for locking the bolt and for unlocking the bolt.

A feature and advantage of embodiments is a rifle having a straight pull bolt action including a bolt with a quickly detachable bolt head. In embodiments, the caliber of the firearm can be changed by removing a first bolt head and replacing it with a second bolt head. In embodiments, the first bolt head is dimensioned and configured for a first caliber and the second bolt head is dimensioned and configured for a second caliber different from the first caliber. In embodiments, the quickly detachable bolt head provides for simple and fast caliber conversion.

In embodiments, when the bolt head is swapped out, a first barrel assembly with a barrel sized for the first caliber may be swapped out for a second barrel assembly with a second barrel sized for the second caliber. In embodiments, the respective barrel assemblies are not disassembled. Each barrel assembly comprising a barrel with a threaded end threaded onto a barrel extension and secured thereto by a barrel nut on the barrel threaded end tightened onto a forward face of the barrel extension with a barrel lug positioned between the barrel nut and the forward face of the barrel extension. The barrel assemblies are preassembled to provide the correct head spacing at the factory. The barrel lugs on each barrel interface with a forward surface of the receiver, for example a vertical rib on the barrel lugs fit into a corresponding groove on the forward face of the receiver. The receiver having a barrel assembly clamping portion where the generally tubular receiver has longitudinal slit whereby the forward receiver clamping portion has a C shape. A plurality of screws and barrel nuts pull the opposing sides of the clamping portion together on the outer cylindrical surface of the barrel extension with on barrel nut registering in a groove cut in the bottom of the barrel extensions of the barrel assemblies. A feature and advantage is that the barrel lug with the interface rib interfacing with the forward face of the receiver establishes the relative and correct rotational position and the correct relative axial location, along with the barrel nut interfacing with the barrel extension groove.

A feature and advantage of embodiments is a rifle having a straight pull bolt action with an automatic locking bolt handle when rifle is cocked and cartridge loaded, and with a release button on back of the bolt for unlocking the locked bolt handle.

A feature and advantage of embodiments is a rifle having a straight pull bolt action having a pre-extraction plunger design with bolt handle lock back.

A feature and advantage of embodiments is a rifle having a straight pull bolt action with a single step release of a bolt stop. In embodiments, a releasable bolt stop requires first a sliding forward motion before an inward depression to release the bolt assembly from the receiver.

A feature and advantage of embodiments is a rifle having a straight pull bolt action with cam and spring activated fixed ejection arrangement.

A feature and advantage of embodiments is a rifle having a straight pull bolt action that provides for a tool-less bolt assembly/disassembly process.

A feature and advantage of embodiments is a rifle having a straight pull bolt action with a positionable handle that allows for ergonomic operation.

A feature and advantage of embodiments is a rifle having a straight pull bolt action incorporating a linkage design that enables tight closure of breech. In embodiments, the tight closure of the breech provides improved accuracy.

A feature and advantage of embodiments is a rifle having a straight pull bolt action with a barrel nut swing process applied to a barrel with an extension for adjustable head spacing and quick barrel conversion.

A feature and advantage of embodiments is a rifle having a straight pull bolt action with a bolt handle lock that locks the bolt closed when the rifle is cocked to avoid being accidently knocked open. In embodiments, the bolt handle lock can be quickly released for opening without firing if needed.

A feature and advantage of embodiments is a rifle having a straight pull bolt action including a unique plunger design for casing pre-extraction.

A feature and advantage of embodiments is a rifle having a straight pull bolt action with a simple releasable bolt stop design that provides for easy manipulation and ready accessibility.

A feature and advantage of embodiments is a rifle having a straight pull bolt action with a cam surface that cooperates with a spring to place the ejection arm in a desired position.

A feature and advantage of embodiments is a rifle having a straight pull bolt action designed to facilitate simple tool-less assembly. In embodiments, bolt components are configured to assist in assembly.

A feature and advantage of embodiments is a rifle that is configured to receive a magazine holding a plurality of cartridges to be fired by the rifle. In embodiments, the use of removable magazines allows a plurality of cartridges to be easily loaded into the rifle by inserting a single magazine into the firearm. In embodiments, the rifle that is configured to receive Accuracy International Chassis System (AICS) magazines.

A feature and advantage of embodiments is a rifle having a straight pull bolt action with a magazine well adaptor plate for long action AICS magazines.

A feature and advantage of embodiments is a rifle having a straight pull bolt action with a magazine release button extension for short action AICS magazines.

A feature and advantage of embodiments is a rifle having a straight pull bolt action with a steel plate that is used to control the AICS magazine height and eliminate wear on the receiver.

A feature and advantage of embodiments is a rifle having an aluminum receiver for reduced weight.

A feature and advantage of embodiments is the bolt operation mechanism being substantially contained in a bulbous housing at the rearward end of the bolt assembly, the bulbous housing may be formed of polymer and may provide support and components for the bolt operation mechanism and the linkages associated therewith. For example, the bulbous housing may provide a pivot pin support base for a bolt lock release thumb pushbutton, and for example, the bulbous housing many provide a cam surface and containment of a linkage providing a gradual bolt assembly-receiver separation, in particular a linkage to push the bolt assembly away from the receiver. The bolt lock release button may be configured as a rocker lever/switch formed of the same material, for example a polymer as the bulbous housing.

A feature and advantage of embodiments is a rifle having a straight pull bolt action with a magazine catch/release located on the trigger guard of the rifle. In embodiments, the magazine catch is extended for use with short magazines. In embodiments the trigger guard has a narrowed portion and the magazine catch/release has a pushbutton with a conforming slot to receive the trigger guard at the narrowed portion. In embodiments, a catch portion is displace forwardly from the pushbutton by a slider mechanism.

In embodiments herein, improvements are provided in straight pull rifles relating to speed of operation, ergonomics, ease in finding the operational controls, easy convertibility from right to left handed use and vice versa, flexibility in changing ammunition, and less complexity in making such conversions to different ammunition, particularly with no tools or minimal tools, and providing a robust action that can be manufactured for less than competitive straight pull rifles.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figures 1A, 1B:
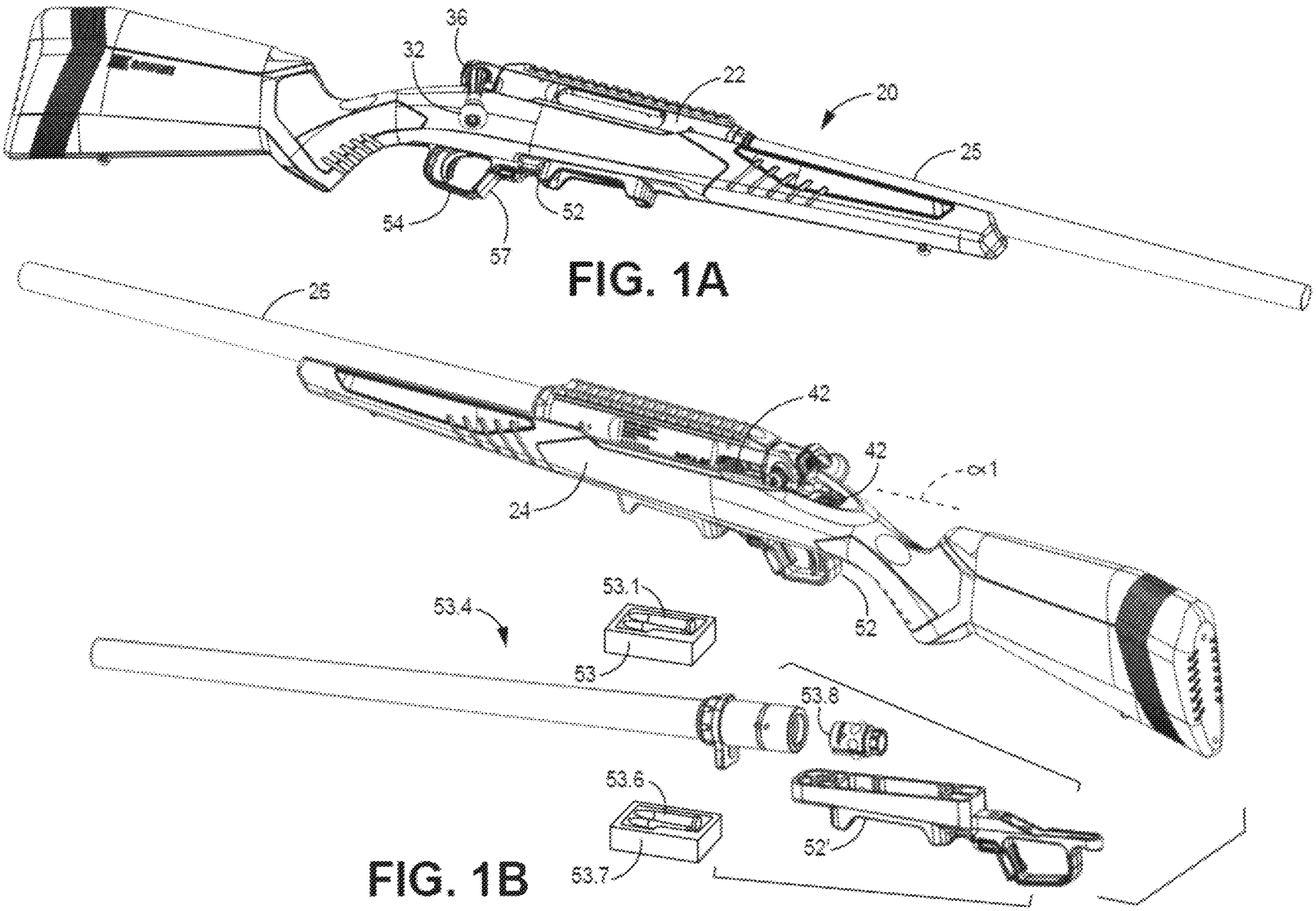
FIG. 1A is a perspective view showing a straight pull rifle according to embodiments.
FIG. 1B is a perspective view of the straight pull rifle of FIG. 1 and with a kit for changing the configuration of the rifle for a different ammunition.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Referring to FIGS. 1A and 1B, a straight pull bolt action rifle 20 has a receiver 22 supported by a stock 24, a barrel assembly 25 with a barrel 26 extending forward of the receiver 22, a bolt assembly 30 with a bolt handle 32, a bolt release button 36, a safety tab 40, and a releasable bolt stop 42 or bolt removal release lever, a lower frame 52 with an integral trigger guard 54 and magazine well 55. The barrel and rifle have a longitudinal axis a1. The rifle is configured for firing a first ammunition and receives a magazine 53 of said first ammunition 53.1. The rifle is modular such that with minimal effort as described in more detail below, the rifle can be readily reconfigured with a kit 53.4 for a second ammunition 53.6 in a second magazine 53.7. The kit comprising a second lower frame 52', a second barrel assembly 25', and second bolt head 53.8 (the first bolt head is not shown in FIGS. 1A and 1B).

Figure 2A:
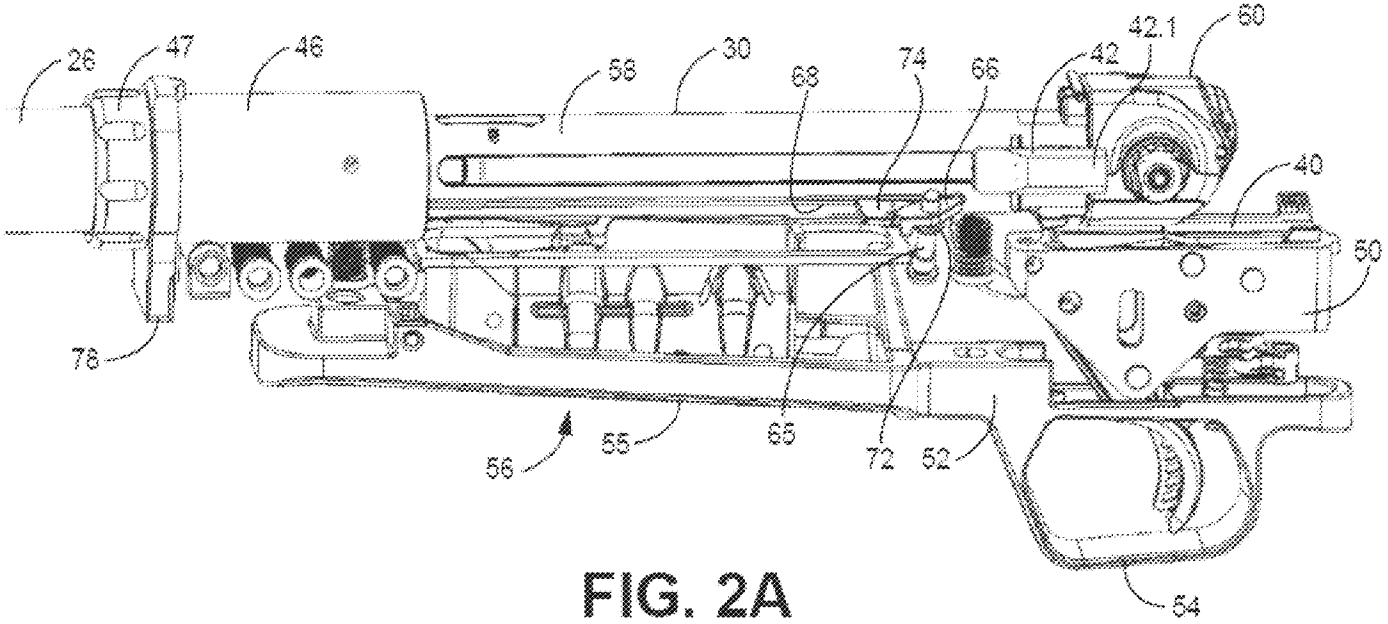
FIG. 2A is a side perspective view of a straight pull rifle with the receiver and stock removed showing the mechanisms of the rifle.
Figure 2B:
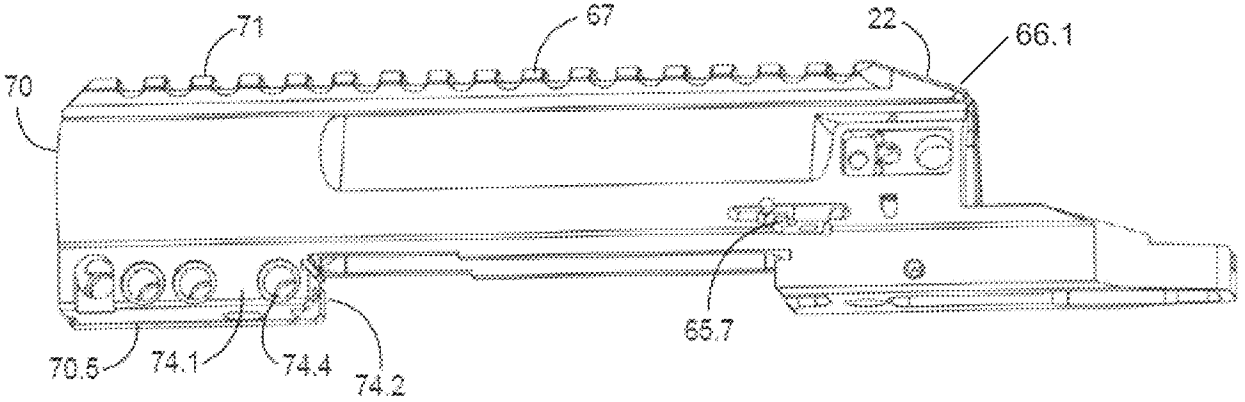
FIG. 2B is the receiver removed from the straight pull rifle of FIG. 2A.
Figure 2C:
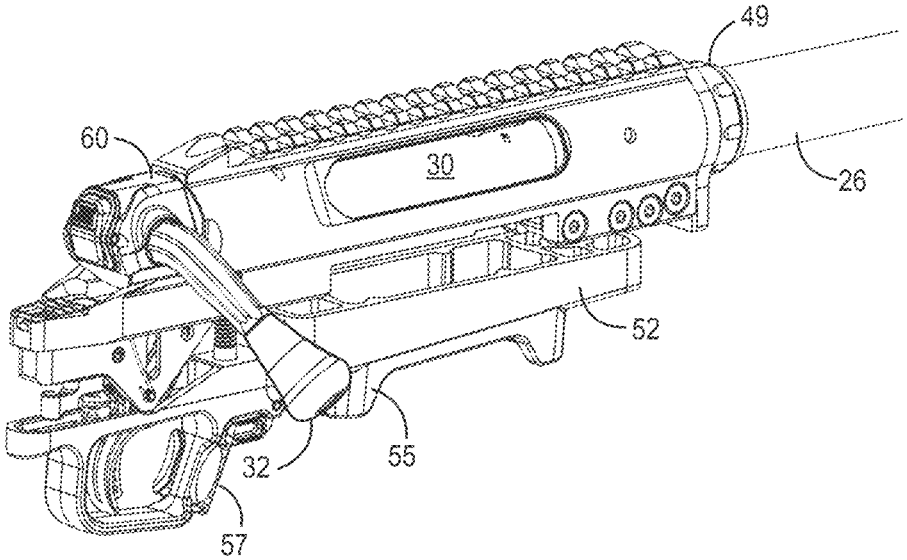
FIG. 2C is a side perspective view of the straight pull rifle of FIG. 1A with the stock removed revealing mechanisms.
Figure 2D:
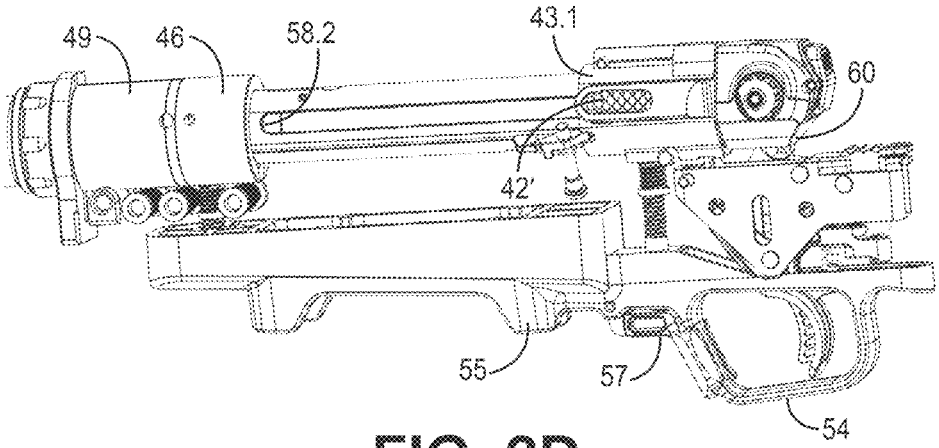
FIG. 2D is a side perspective view of the rifle of FIG. 2C from the opposite side and without the receiver.
Figure 2E:
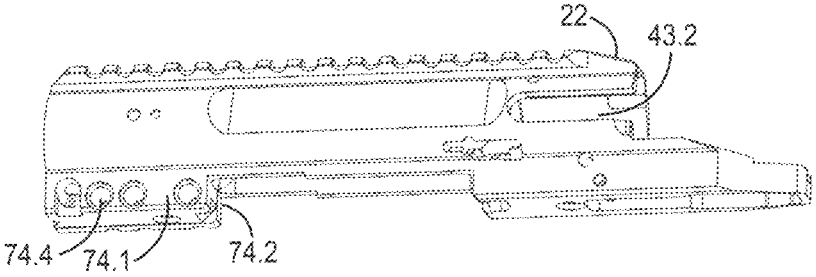
FIG. 2E is the receiver of the rifle of FIG. 2D.
Figure 2F:
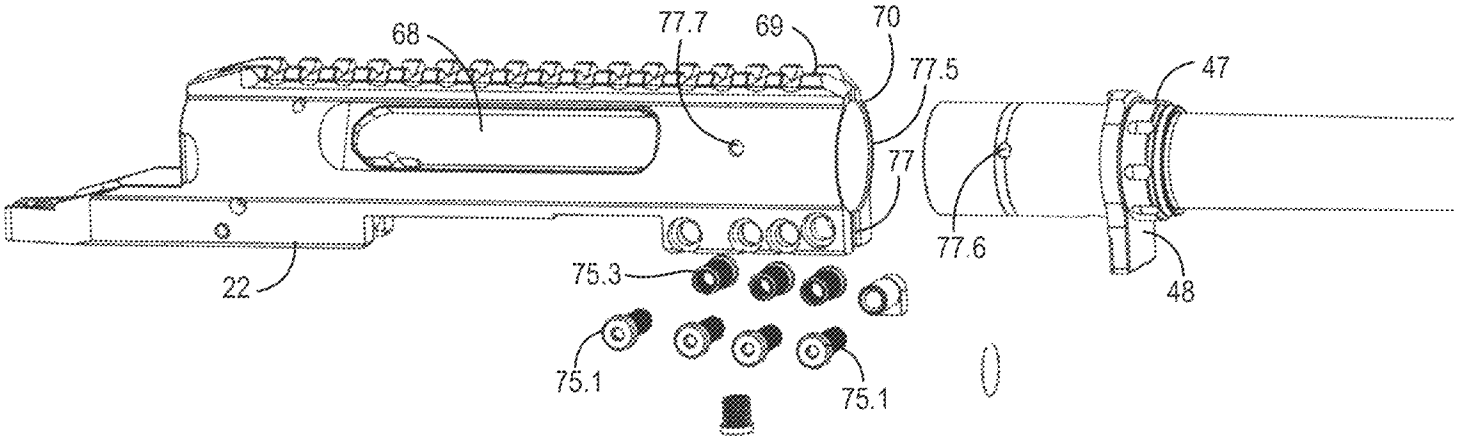
FIG. 2F is an exploded view of the connection system of a straight pull rifle between the receiver and a barrel assembly.
Figure 2I:
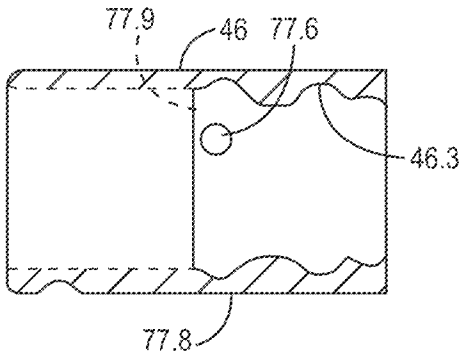
FIG. 2I is a cross-sectional view of the barrel extender of FIG. 2F.
Figure 2H:
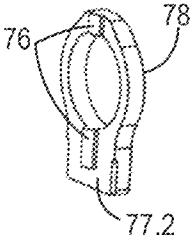
FIG. 2H is a perspective view of the barrel lug of FIG. 2F.
Figure 2G:
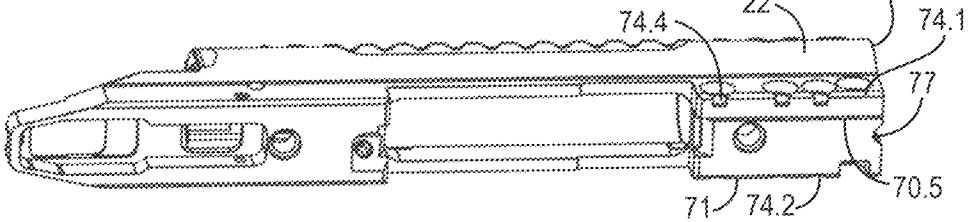
FIG. 2G is a perspective view of the receiver of FIG. 2F.
Figure 3:
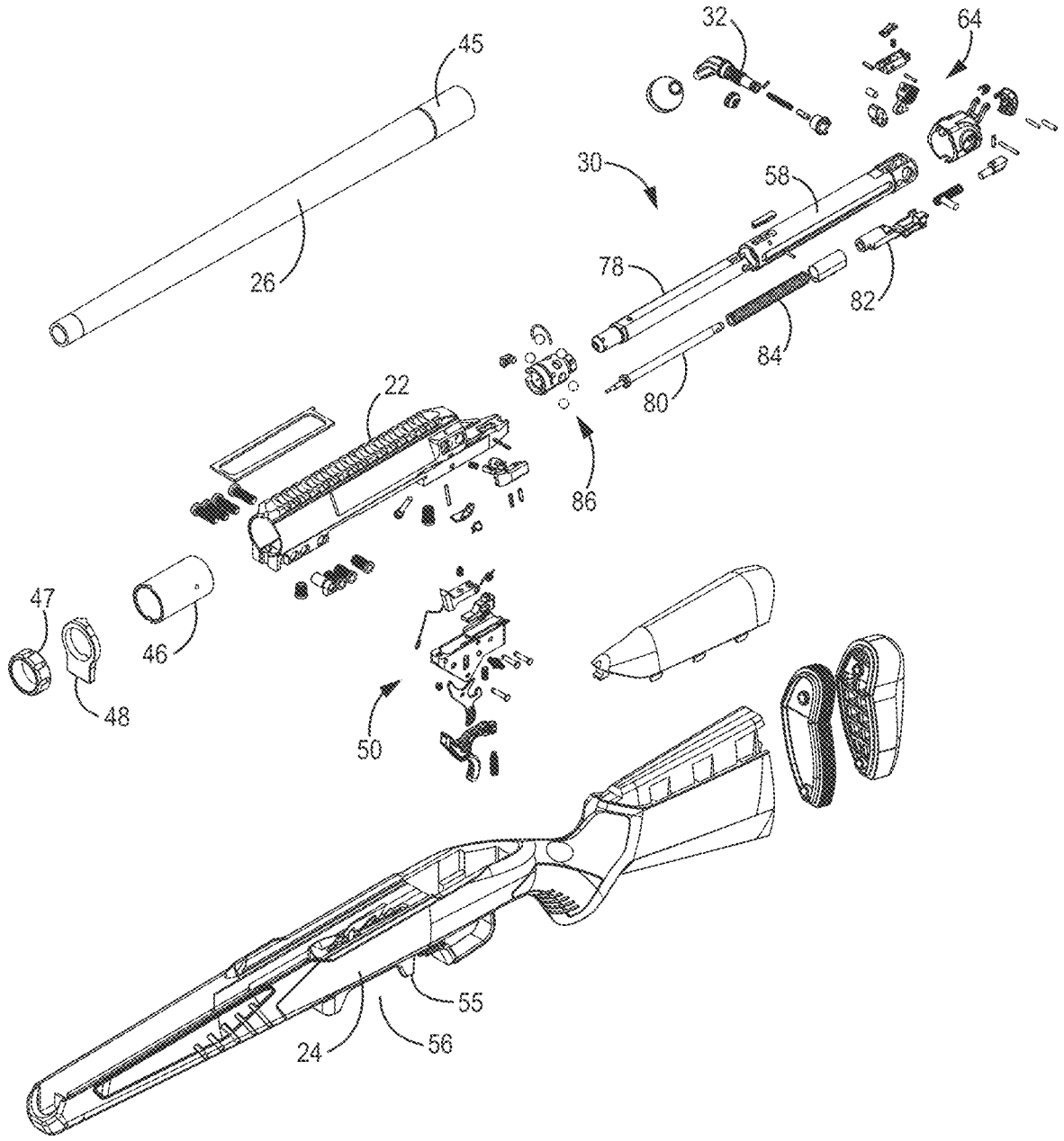
FIG. 3 is an exploded view of a straight pull rifle.

Referring to FIGS. 2A to 2H, as well as the exploded FIG. 3, further portions and components of the firearm are illustrated, in particular those associated with the receiver 22, the barrel assembly 25, and bolt assembly 30. The barrel 26 has a rearward threaded end 45 that connects to a threaded barrel extension 46 with a barrel nut 47 and barrel lug 48; these components defining the barrel assembly 25. The barrel extension 46 receives a forward end of the bolt assembly 30 as describe in further detail below. A trigger mechanism 50 is positioned below the bolt assembly above a lower frame 52 that has a trigger guard 54 and a magazine well 55 defining a magazine receiving region 56. In embodiments, a magazine release lever 57 is nested about a forward portion of the trigger guard. The trigger mechanism 50 may include features of the AccuTrigger® system of Savage Arms, Inc., the owner of the instant application. See U.S. Pat. No. 6,553,706 incorporated by reference herein. The bolt assembly includes a bolt body 58 extending from a bolt mechanism housing 60 configured as a bulbous rearward bolt cap that contains bolt operation mechanism 64. The bolt assembly disposed in the receiver secured to the stock. The stock includes components known as the AccuStock® system and AccuFit® systems by Savage Arms, Inc., see U.S. Pat. No. 10,690,440 incorporated herein by reference for all purposes.

The receiver 22 has a rearward end 65.1, a mid-portion 67 with an ejection port 65.3, and a forward end 69 with a forward face 70. As best shown in FIG. 2G, a slit 70.5 may extend longitudinally along a front clamping portion 71 of the receiver. The clamping portion 70 having an interior cylindrical surface 72 for engaging the cylindrical exterior surface 73 of the barrel extension 46 of a barrel assembly 25. At the slit defining a C shape of the forward clamping portion, opposing clamping lugs 74.1, 74.2 have holes 74.4 for screws 75.1 and barrel nuts 75.3 for pulling the opposing clamping lugs together about the barrel extension. The different barrel assemblies, for example for different sized ammunition, have identically configured and sized exterior surfaces and features so that all interface the same with the receiver at the forward face of the receiver providing the correct head space. The barrel lug 48 has a forward vertical rib 76 that interfaces with a vertical groove 77 on the forward face 70 of the receiver 22. Moreover, the rearward facing surface 77.2 of the barrel lug interfaces with the flat forward surface 77.5 of the forward face 70 of the receiver 22.

Referring to FIGS. 2C, 2F, and 2I, the barrel extension and receiver each have a vent hole 77.6, 77.7 and the barrel extension has a circumferential thinned region 77.8 extending around the barrel extension and positioned about at the breech face 77.9 of the rifle. The cross section of FIG. 2I depicts the internal threaded portion 46.2 that cooperates with the threaded end of the barrel, a recess 46.3 for receiving the locking rollers of the bolt head 86. The thinned region and vents provide a failure pathway in the unlikely event of a cartridge explosion at the breech face that is potentially less hazardous than without. The vents can lessen the explosive force, and the thinned region may facilitate the barrel dislocating from the rifle in the proximity of the thinned region 77.8 rather than having more severe damage rearward of the breech face.

Figure 4A:
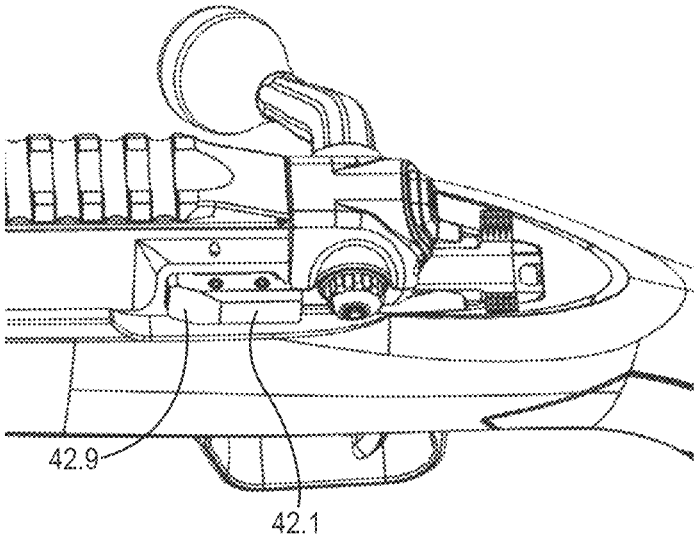
FIG. 4A is a perspective view of a portion of a straight pull rifle with a releasable bolt stop.
Figure 4B:
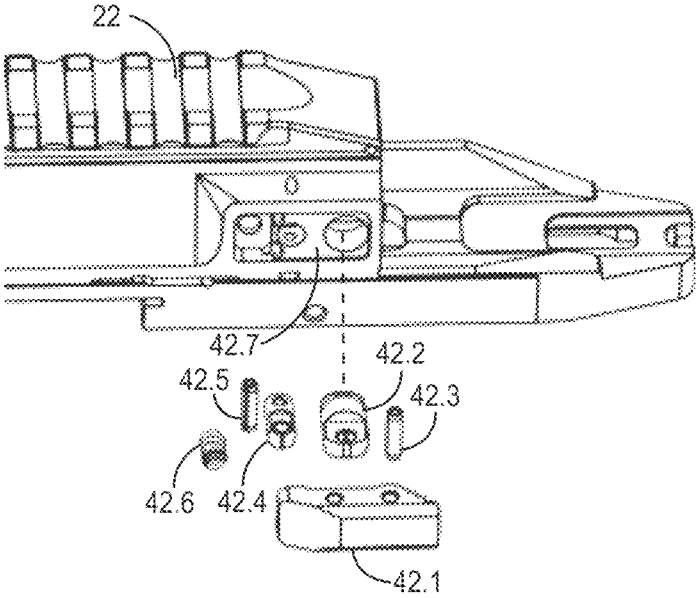
FIG. 4B is an exploded view of the releasable bolt stop mechanism of FIG. 4A.
Figure 4C:
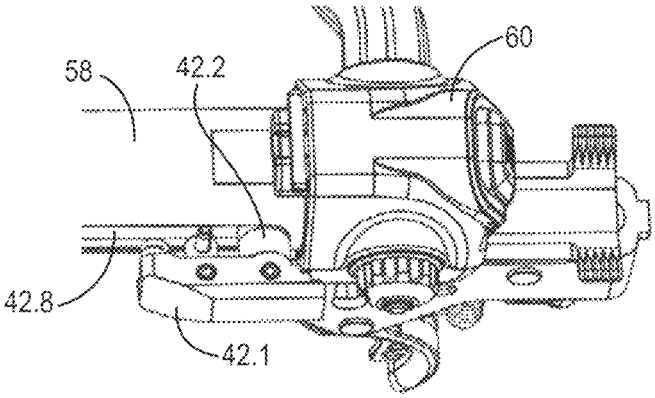
FIG. 4C is a perspective view of the mechanism of FIG. 4*a* without the bolt stop insert housing.
Figure 4D:
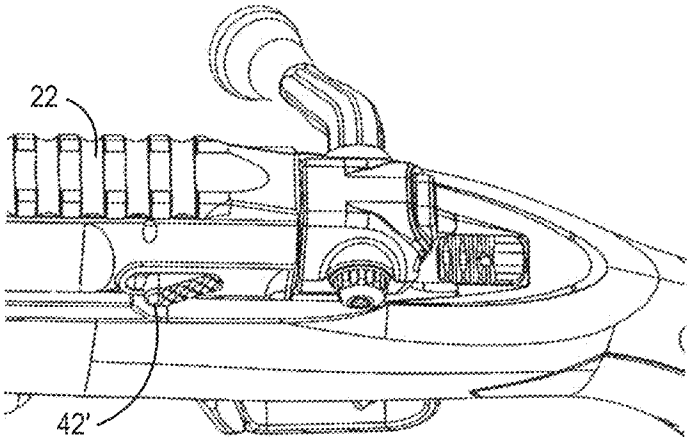
FIG. 4D is a perspective view of another embodiment of a releasable bolt stop.
Figure 4E:
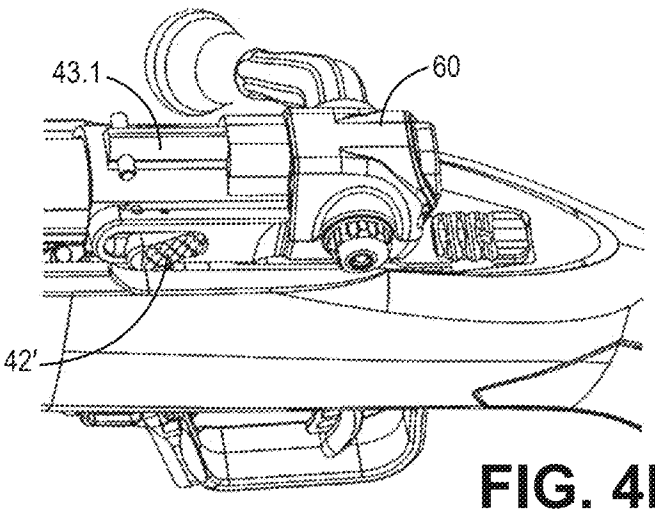
FIG. 4E is a perspective view of the releasable bolt stop of FIG. 4D with the receiver removed.

Referring to FIGS. 2A, 2B, and 4A to 4C, a releaseable bolt stop 42 embodiment is depicted and generally comprises a bolt stop lever 42.1, a bolt groove engaging plunger 42.2, a plunger pin 42.3, a pivot arm 42.4, pivot arm pin 42.5, and bias spring 42.6. The components of the bolt stop are attached to the receiver 22 at a bolt stop lever recess 42.7, as best shown in FIGS. 2B and 4B. The plunger 42.2 seats in the larger hole and rides in the bolt stop groove 42.8 in the bolt body 58. When the bolt assembly is retracted, that is, moved rearwardly from the in battery position, the plunger will follow the bolt stop groove 58.1 in the bolt body until it reaches the stop surface 58.2 at the end of the bolt stop groove 42.8 such as is shown in FIG. 2D. The stop surface will stop the retraction. The user may raise the plunger from the groove and the stop surface by depressing the forward portion 42.9 of the lever 42.1 which then allows the bolt assembly to be removed from the receiver subject to other mechanism interconnections.

Figure 4F:
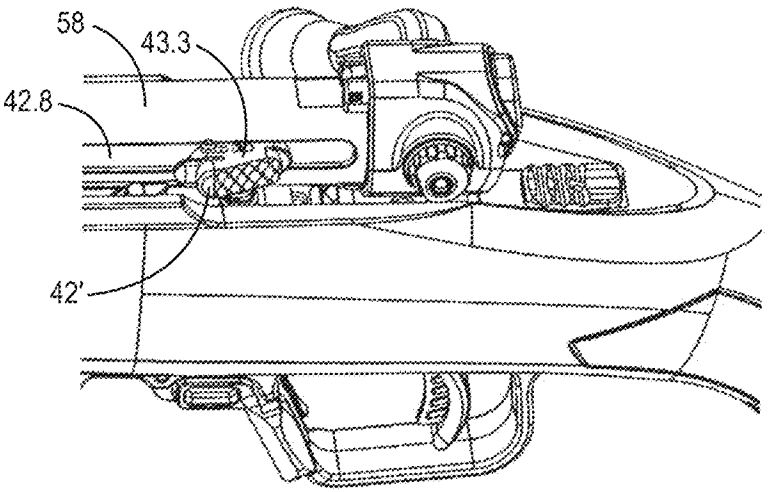
FIG. 4F is a perspective view of the bolt stop of FIG. 4D with the bolt stop insert removed showing the engagement with the bolt stop groove in the bolt body.
Figure 4G:
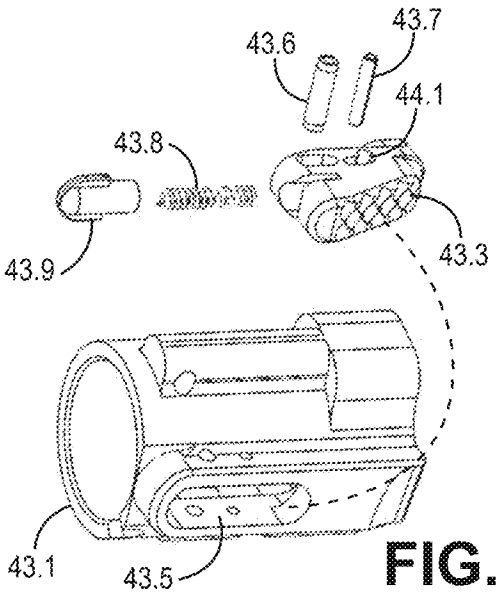
FIG. 4G is an exploded perspective view of the bolt stop insert and other components of the bolt stop of FIG. 4D.
Figure 4H:
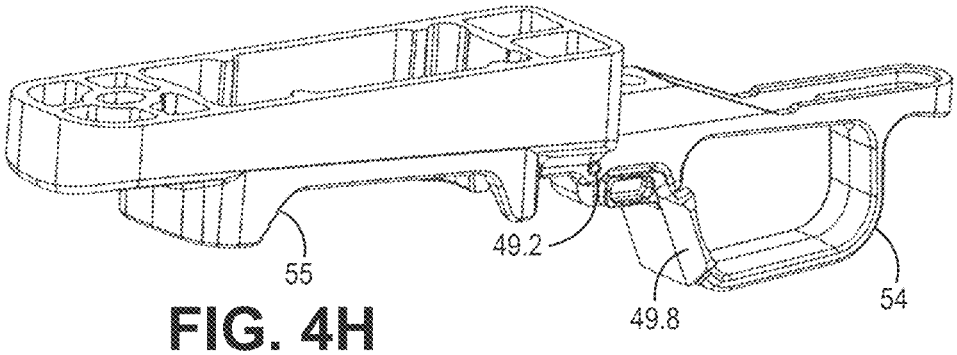
FIG. 4H is a perspective view of a lower frame of a straight pull rifle with a magazine well and magazine release lever nested around the trigger guard.
Figure 4I:
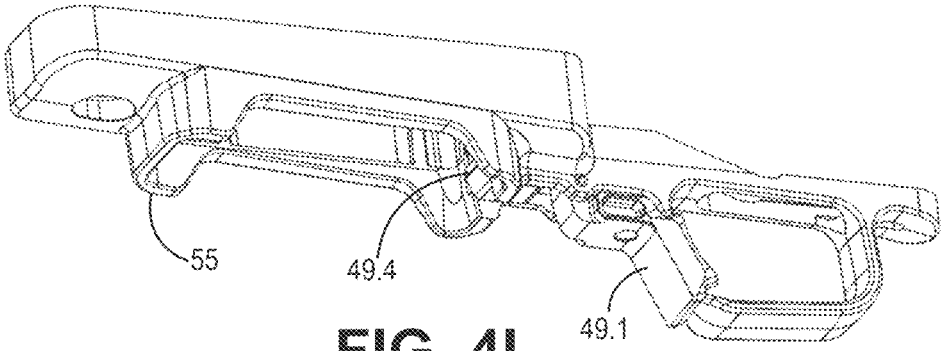
FIG. 4I is another perspective view of the lower frame of FIG. 4H.
Figure 4J:
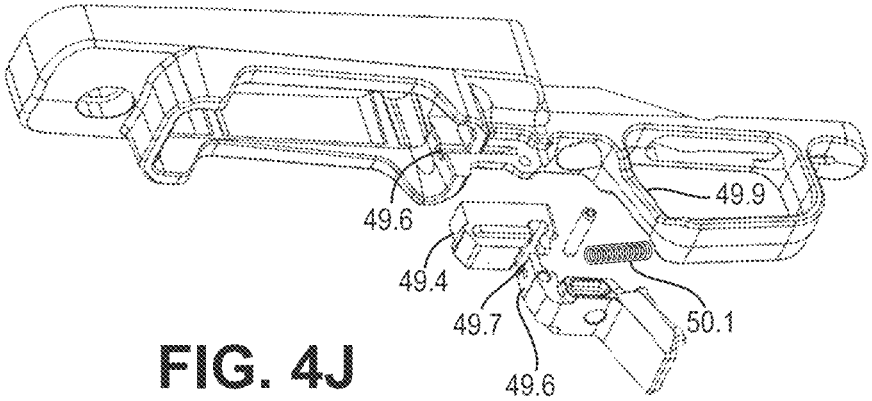
FIG. 4J is an exploded perspective view of the lower frame of FIGS. 4I and 4J.
Figure 4K:
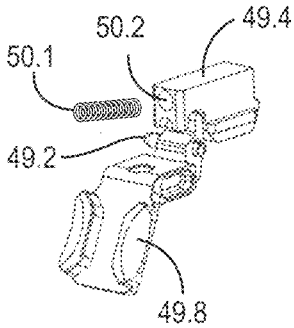
FIG. 4K is a perspective view of the components of the magazine release mechanism.

Referring to FIGS. 2D, 2E, and 4D-4G, another releaseable bolt stop 42' is illustrated that is secured to a bolt stop insert 43.1 rather than directly to the receiver 22. The insert may generally provide structural support to the receiver 22 and a slot 43.2 in the receiver 22 provides access to the bolt stop 42' by a user. The releaseable bolt stop 42'comprises a bolt stop lever 43.3 with a bolt stop groove engaging portion 43.4 and is pivotally and movable supported in a bolt stop recess 43.5 in the insert 43.1 by pins 43.6, 43.7. A spring 43.8 in conjunction with a bolt stop plunger 43.9 urge the lever 43.3 rearwardly in the recess of the insert 43.1 where, due to an L shaped slot 44.1 in the lever, the bolt stop groove engaging portion is constrained in the bolt stop groove 42.8 as shown in FIG. 4F where the insert has been removed for illustration. As the bolt assembly is retracted rearwardly, the bolt stop lever stays in the groove and abuts against the stop surface 58.2, shown in FIG. 2D. To retract the bolt stop groove engaging portion from the groove, the user must first push the lever forwardly in the bolt stop recess 43.5 in the bolt stop insert and then may depress the forward end 44.3 of the lever to raise the rear end of the lever from the groove allowing the bolt assembly to be fully removed from the insert and receiver.

Referring to FIGS. 1A, 1B, 4H-4K, a magazine release mechanism 49 is illustrated that is attached to the lower frame 52 having the magazine well 55 and trigger guard 54. The mechanism comprises a pivoting lever 49.1 pivotally attached by a pin 49.2 to the lower frame, a slider 49.3 that has a forward magazine catch 49.4. The slider has tabs 49.5 that are received in a slot or slots 49.6 in the lower frame. A operating tab 49.6 of the pivoting lever loosely engages a slot 49.7 in the slider. The slider is constrained in the lower frame by said operating tab. A pair of finger buttons 49.8 nest around the finger guard at a narrowed region 49.9 of the forward strap. A coil spring 50.1 received in an aperture of the slider and compressed against the lower frame urges the slider forwardly and the finger guards engaged against the trigger guard. This provides a less obtrusive magazine release button and provides more surface of the button compared to the surface of the trigger guard strap than conventional magazine releases thereby making actuation easier.

Figure 5A:
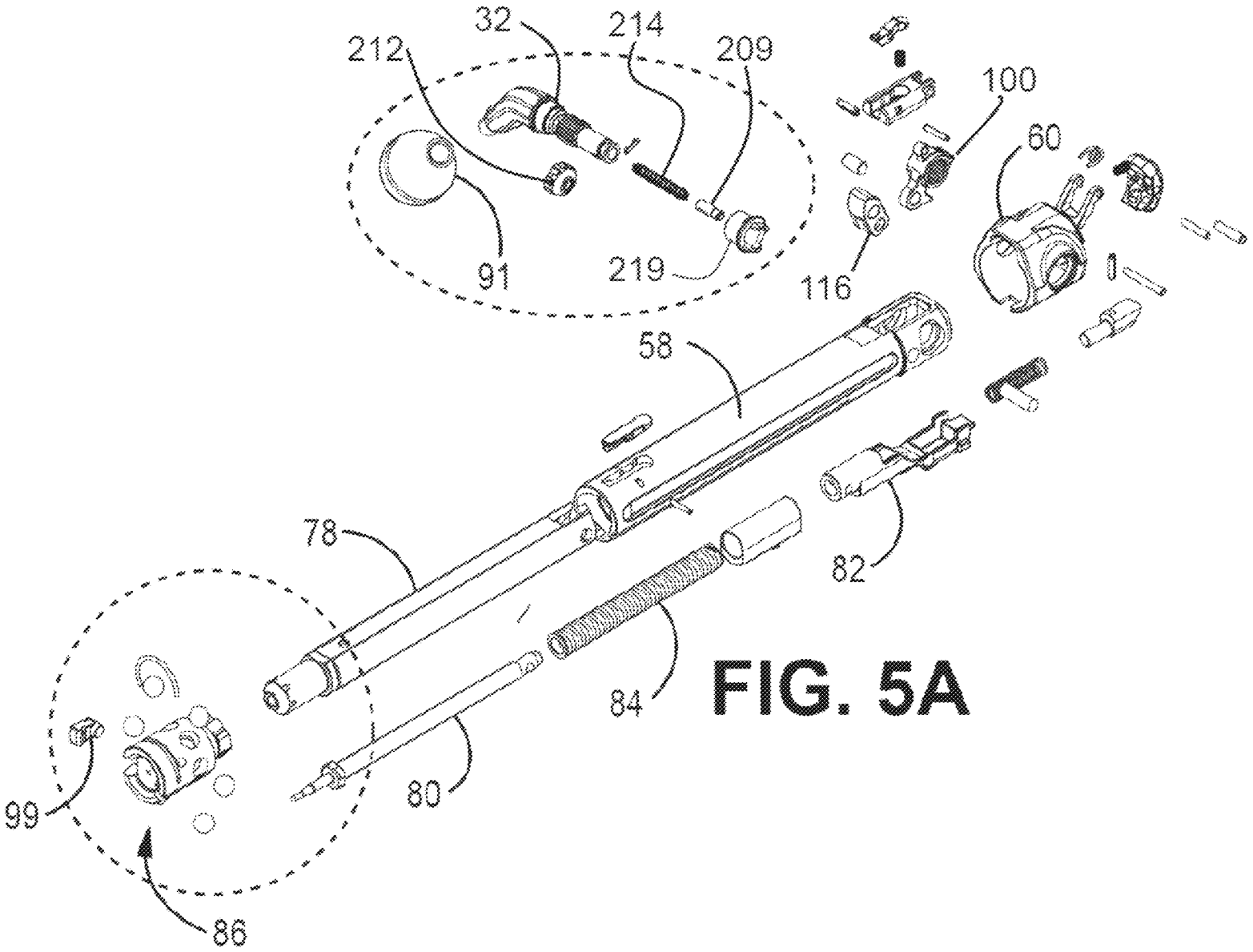
FIG. 5A is an exploded view of a bolt assembly of a straight pull rifle.
Figure 5B:
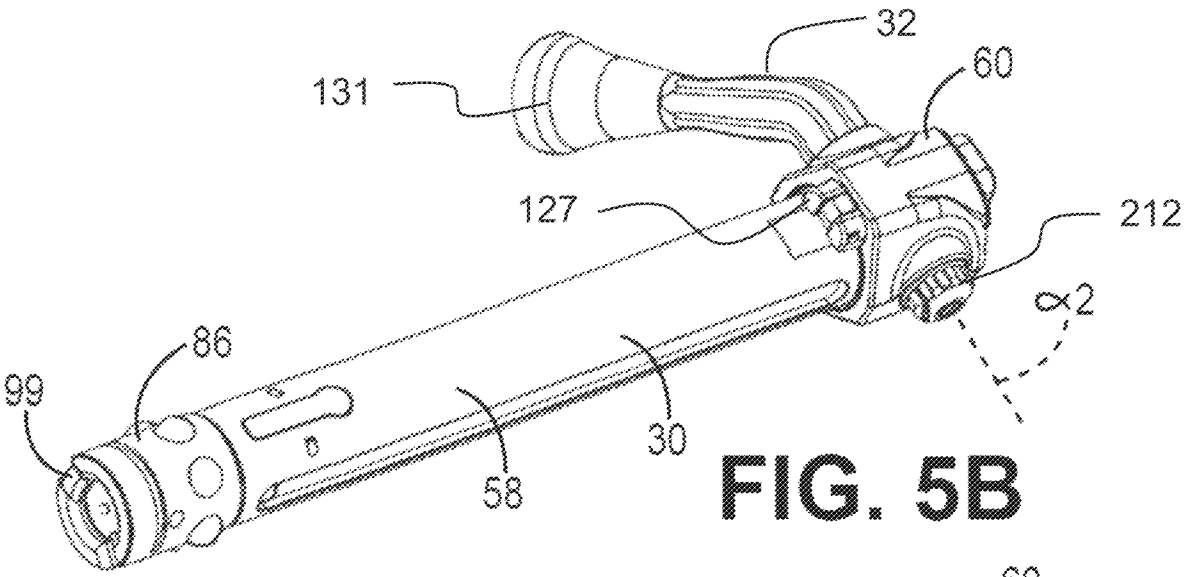
FIG. 5B is a perspective view of a bolt assembly of a straight pull rifle.
Figure 5C:
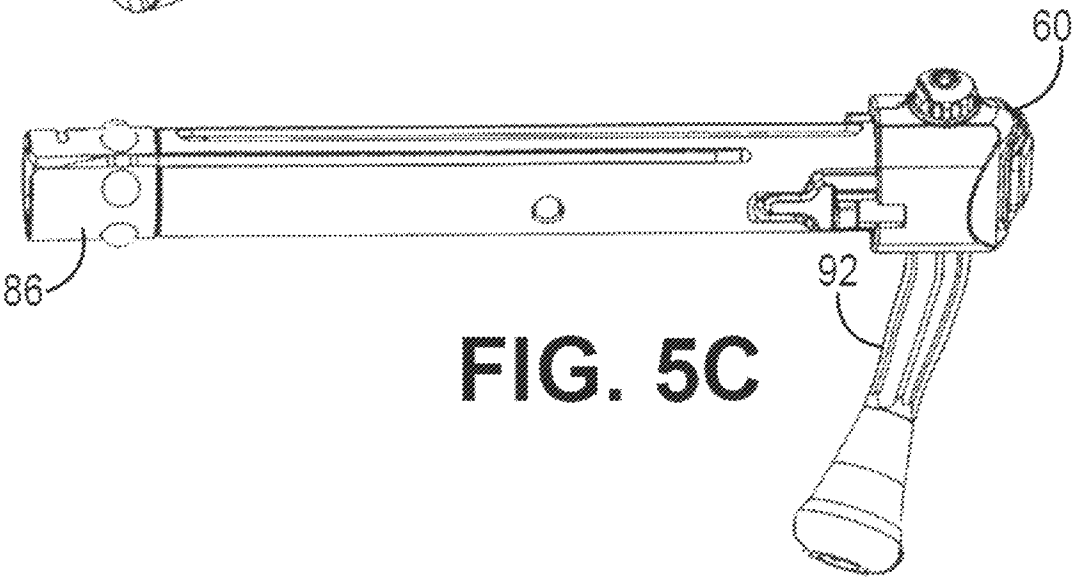
FIG. 5C is another perspective view of the bolt assembly of FIG. 5A.
Figure 5D:
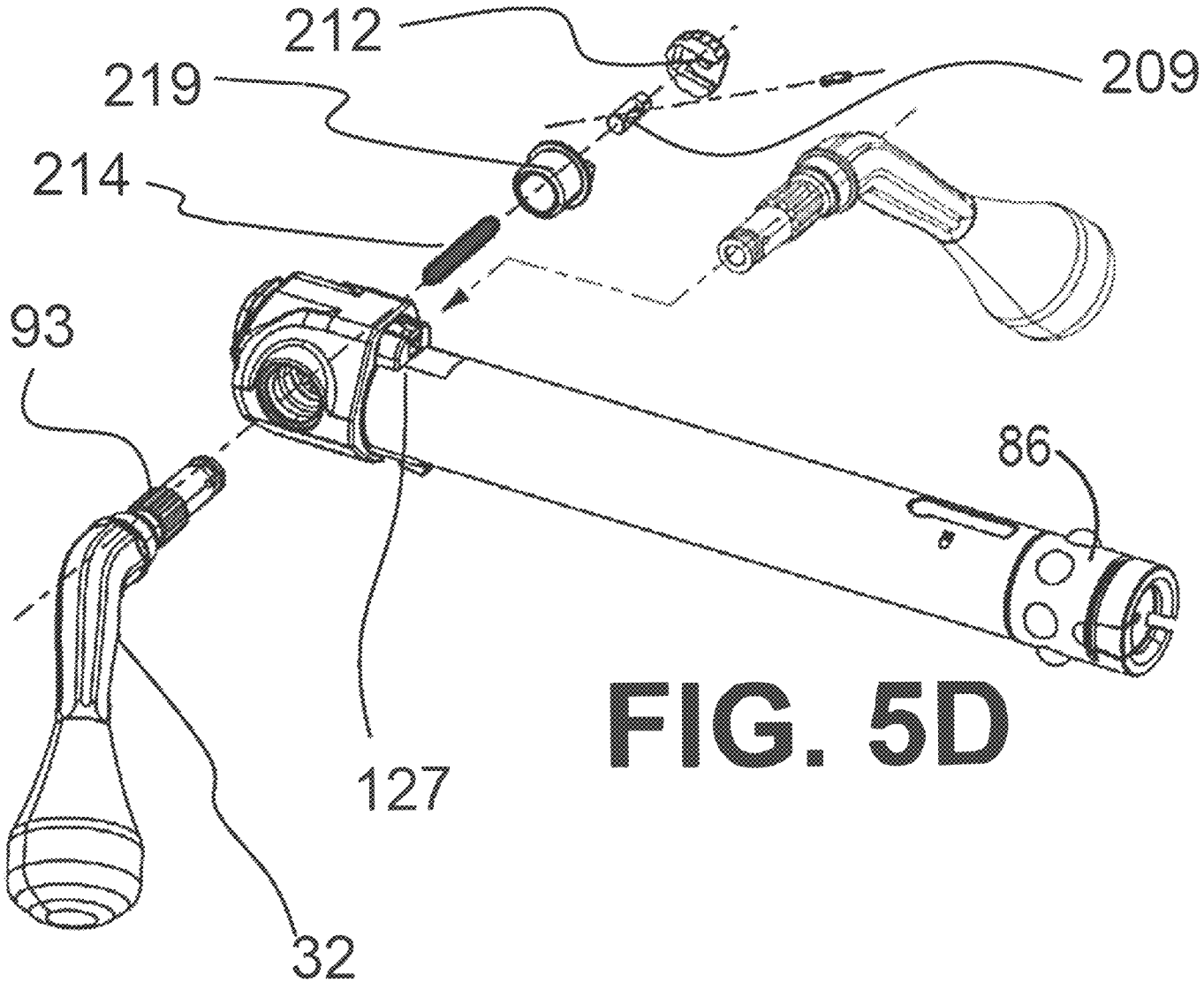
FIG. 5D is an exploded view of the bolt assembly of FIG. 5A.
Figure 5E:
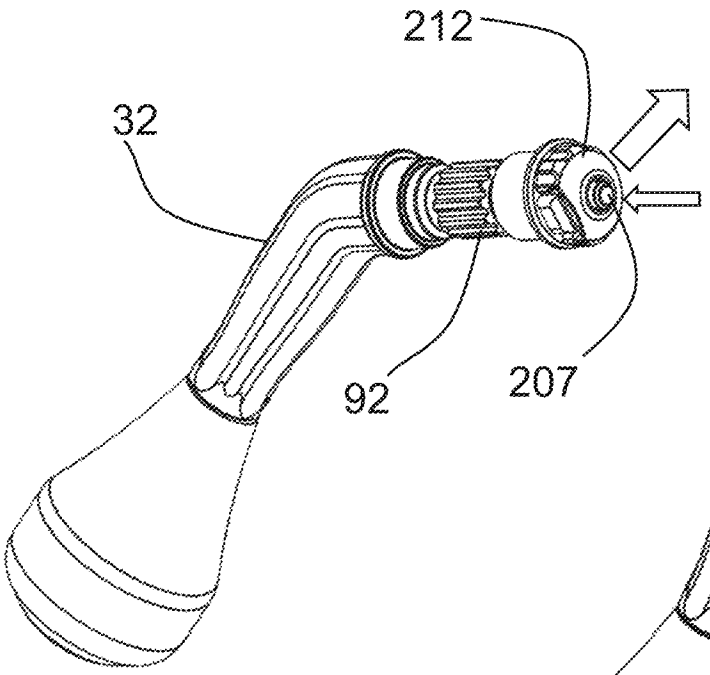
FIG. 5E is a perspective view of a bolt handle showing mechanisms to remove the bolt handle from the bolt assembly.

Referring to FIGS. 3, 5A-5J, the bolt assembly 30 has a bolt body 58, a bolt plunger 78, a firing pin 80 with a firing pin tip 81, a striker 82, a firing pin spring 84, a first bolt head 86. The bolt handle 32 has a manual grasping portion 90 including a knob 91 and a shaft portion 92 with splines 93 that engage with cooperating structure in the bolt operation mechanism 64 discussed below. The bolt body 58 with an open end 95 may receive a second bolt head 53.8 or alternate bolt heads 86.2 for different size cartridges, such which will typically be associated with changing out the barrel assembly as well. In embodiments, each bolt head 86 has cogs or lugs 95.1 extending radially outward that are received in keyed slots 95.2 in the open end of the bolt body. The bolt head may be inserted in an axial direction with respect to the open end of the bolt body and then rotated with respect to the bolt body 58 to position the lugs 95.1 axially behind the radially inward projections 95.3 at the bolt body open end. So positioned, the bolt head cannot be removed without partially rotating the bolt head. See FIG. 5H illustrating the retention position. The bolt head is secured in place by a latch 96 configured as a lever seated in a cutout 96.1 with a pivot pin 96.2. The lever has an outward surface 96.3 that may be flush or recessed with the outward cylindrical surface 96.4 of the bolt body 58. The latch forward end has a stop projection 96.5 that seats between the lugs or cogs of the bolt head in an obstruction position with regard to the bolt head rotation that has been inserted and partially rotated, thereby precluding the bolt head from rotating to a removal rotational position. Again, see FIG. 5H. FIG. 5H shows the rearward end 96.7 of the latch depressed, raising the forward end of the latch to a bolt head rotation position, a non obstructing position. The bolt head as illustrated in FIG. 5I has been rotated to a bolt head removal position and FIG. 5J illustrates the bolt head being pulled out of the open end 95 of the bolt body 58.

The above operations may be performed only when the bolt assembly has been removed from the receiver. When the bolt body is in the receiver, the close tolerance between the exterior surface of the bolt body and the interior surface of the receiver, the latch cannot be moved from the obstruction position to the bolt head removal position. In other embodiments, the latch may simply have a radial inward projection that extends over a catch on the bolt head. The latch again needing to have it forward end raised to a non obstructing position to remove the bolt head.

Referring to FIGS. 21, 5A, 6A-6H, the bolt heads have a plurality of circumferentially spaced apertures 96 that receive locking rollers 98 configured as spheres, or ball bearings, for engaging with recesses on the barrel extension, discussed below. When the bolt plunger 78, specifically the bolt plunger head 78.1, is fully engaged in the interior of the bolt head 86, the roller bearings are forced outward to their fully radial extension position as shown and when in an in-battery position, engage a cooperating circumferential recess in the barrel extension. When the plunger is not present, either by retraction within the bolt body or by removal of the bolt head from the bolt body, the rollers are free to move radially inward.

Figure 6A:
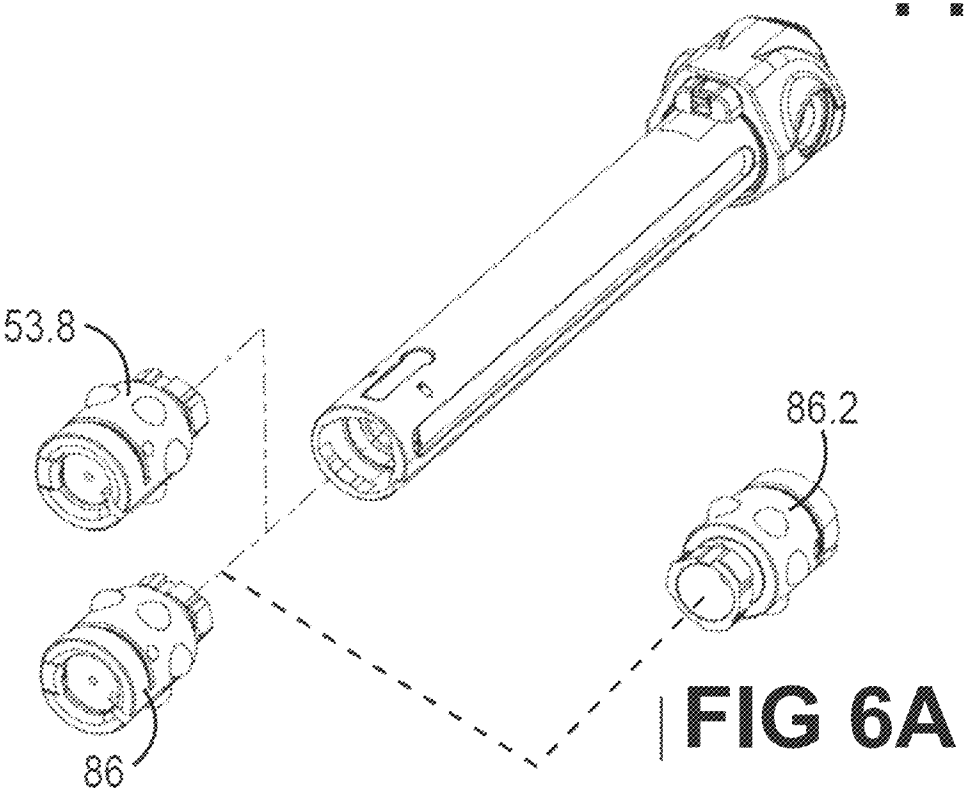
FIG. 6A is a perspective view illustrating that a bolt body can receive different bolt heads.
Figure 6D:
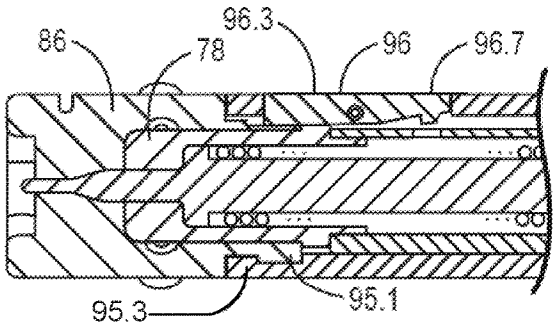
FIG. 6D is a cross sectional view of the forward end of the bolt assembly of FIG. 5F.
Figure 6E:
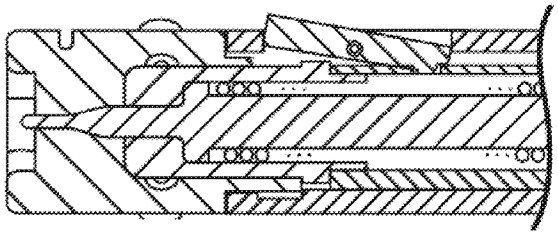
FIG. 6E is a cross sectional view of the bolt assembly of FIG. 5F with the latch for releasing the bolt head actuated.
Figure 6F:
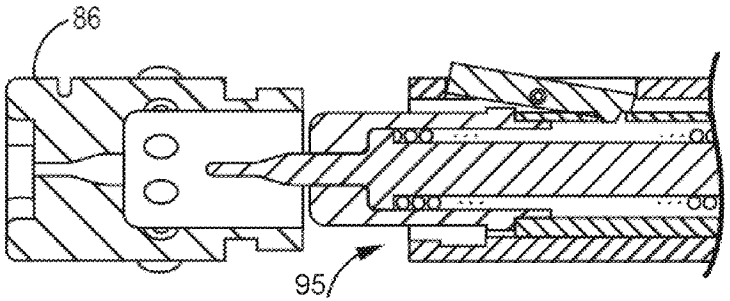
FIG. 6F is a cross sectional view of the bolt assembly of FIG. 5I showing the bolt head separating from the bolt body.
Figure 6B:
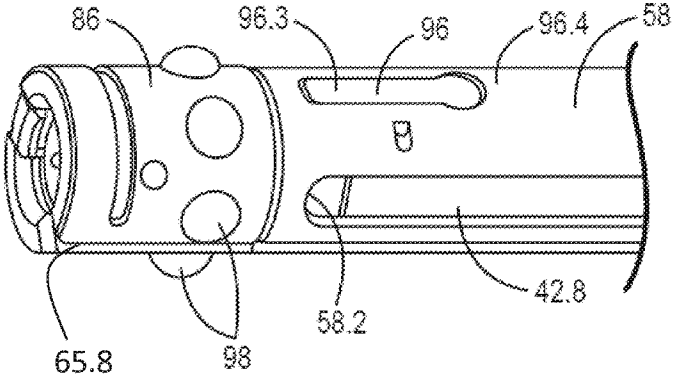
FIG. 6B is a perspective view of the forward end of a bolt assembly of a rifle.
Figure 6C:
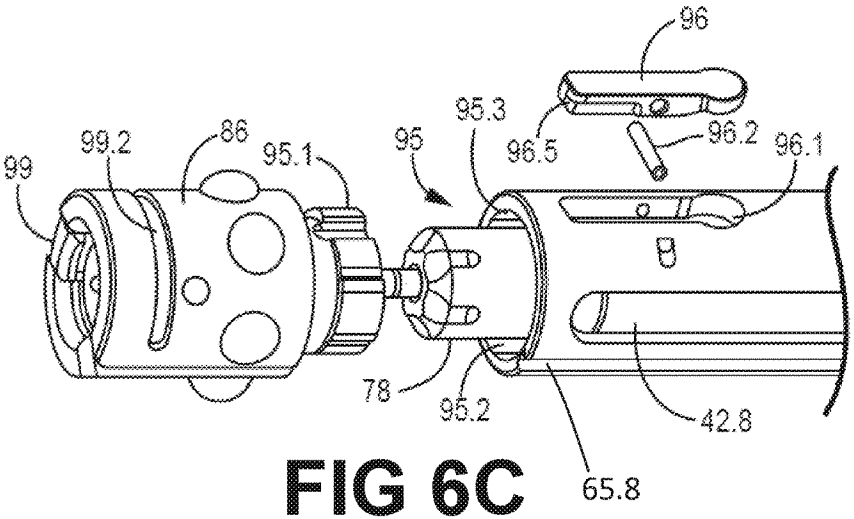
FIG. 6C is a perspective view of the bolt assembly of FIG. 5F with the bolt head removed and the latch exploded.
Figure 6G:
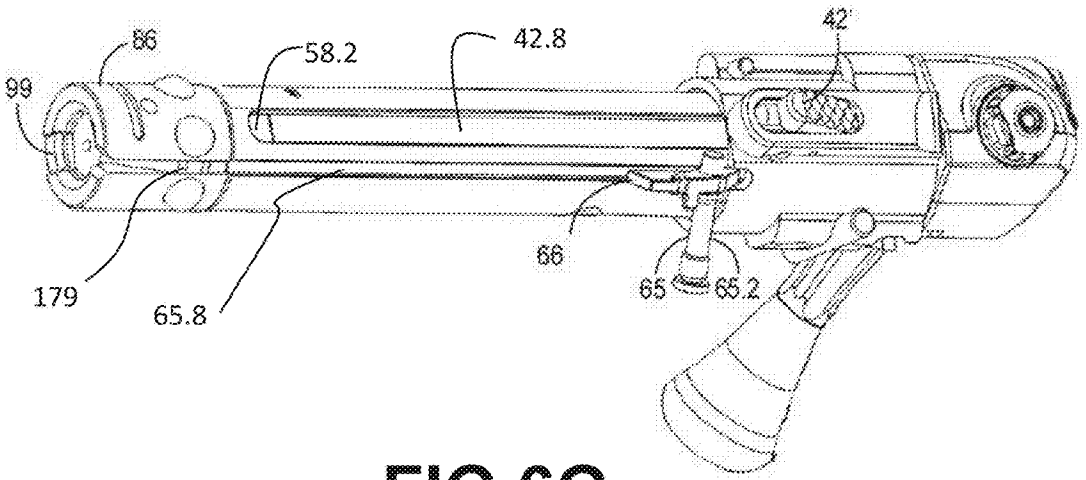
FIG. 6G is a perspective view of a bolt assembly with a ejector engaged in a groove of the bolt body.
Figure 6I:
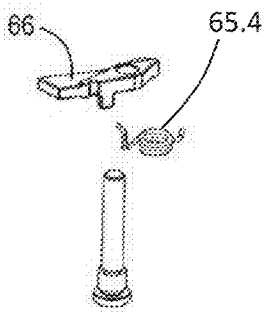
FIG. 6I is an exploded view of the ejector mechanism of FIG. 6A.
Figure 6H:
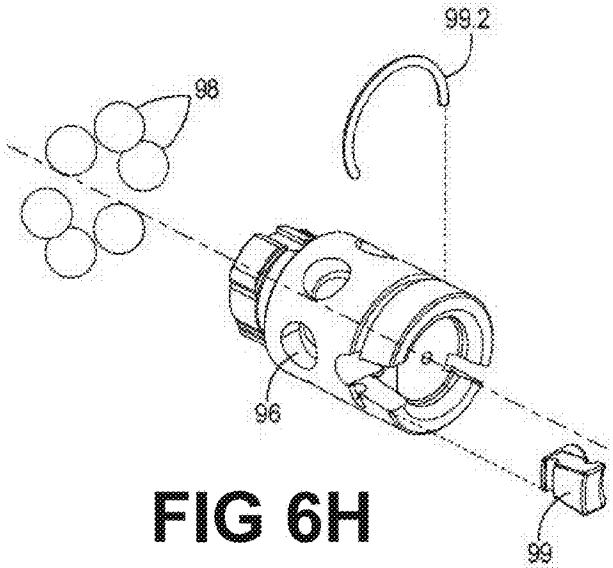
FIG. 6H is an exploded perspective view of a bolt head.
Figure 7B:
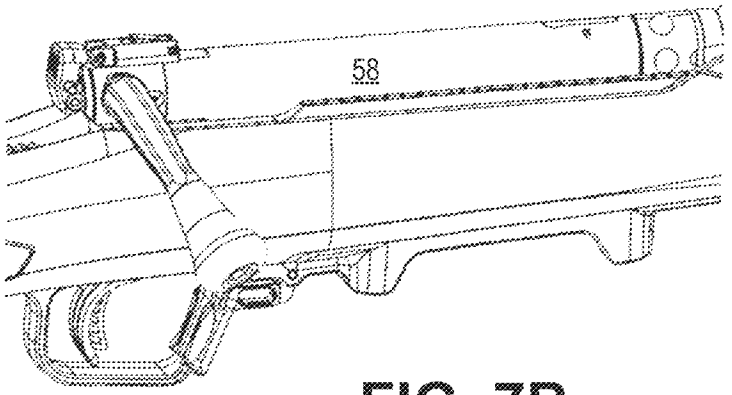
FIG. 7B is a perspective view of the rifle of FIG. 7A with the barrel extender and bolt release insert removed.
Figure 7D:
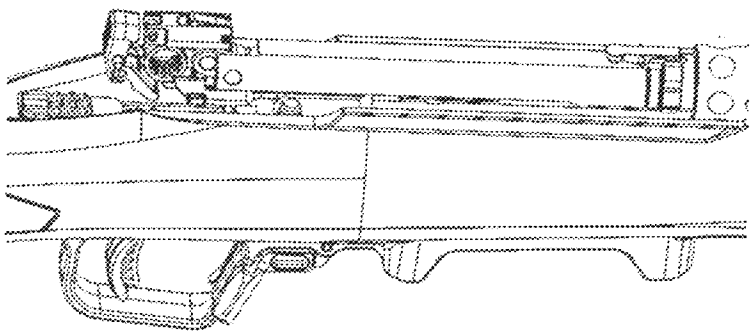
FIG. 7D is a perspective view of the rifle of FIG. 7C with the bolt handle removed.
Figure 7A:
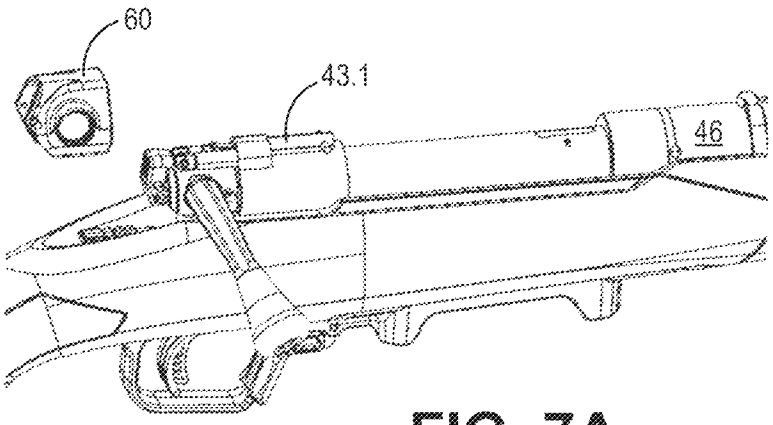
FIG. 7A is a perspective side view of straight pull rifle with the receiver removed illustrating components.
Figure 7C:
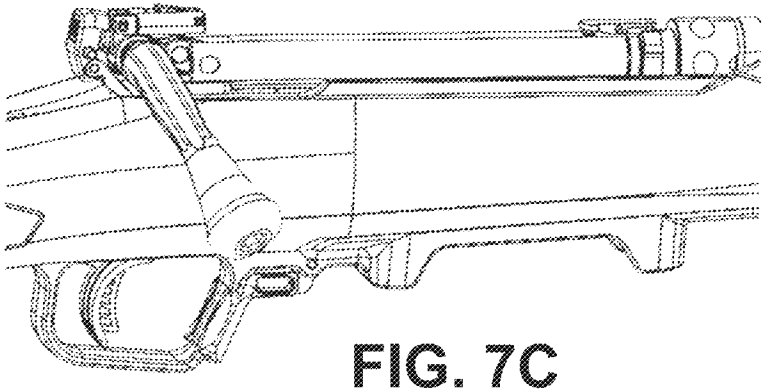
FIG. 7C is a perspective view of the rifle of FIG. 7B with the bolt body removed.
Figure 8:
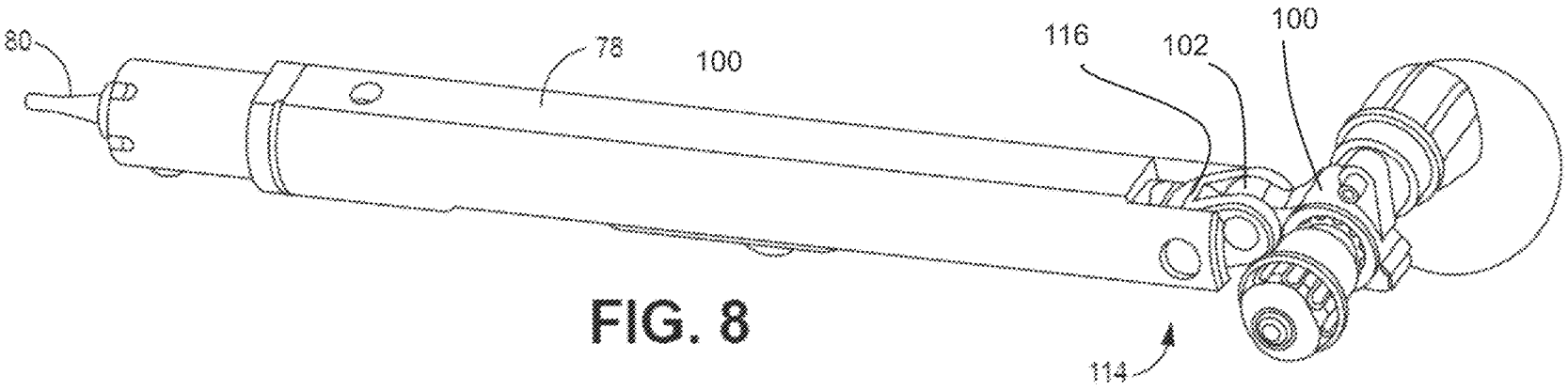
FIG. 8 is a perspective view of the components of a first linkage system.

Referring to FIGS. 6G and 6H, an extractor 99 is retained in each bolt head by way of a spring ring 99.2.

Referring to FIGS. 2A, 2B, 6G, and 6I, an ejector 65 comprises an ejector bar 66 that pivots about post 65.2 and is spring biased by torsion spring 65.4. The post is fixed to the receiver 22 at ejector mounting region 65.7 as best shown in FIG. 2B. The receiver is not shown in FIGS. 2A and 6A so it appears the ejector 65 is unattached, but it will be anchored to the receiver or other structure fixed with respect to the receiver. The forward end 65.5 of the ejector bar rides in the ejector slot 65.8 and is urged therein by the torsion spring. The ejector slot has an elevated portion 179 that acts as a cam surface when the forward end passes the raised portion and the rearward end of the ejector bar, as a cam follower, follows the raised portion and forces the forward end into the cartridge holding region of the bolt head to eject the cartridge therein. See the discussion below with reference to FIGS. 17A-17D.

Referring to FIGS. 7 and 8-11, the components of various sub-mechanisms or linkage systems that make up the bolt operation mechanism 64 and actuated by the bolt handle 32 are illustrated. The operation of the bolt operation mechanism including the linkage systems in various stages are illustrated in FIGS. 12A-17D.

Figure 12A:
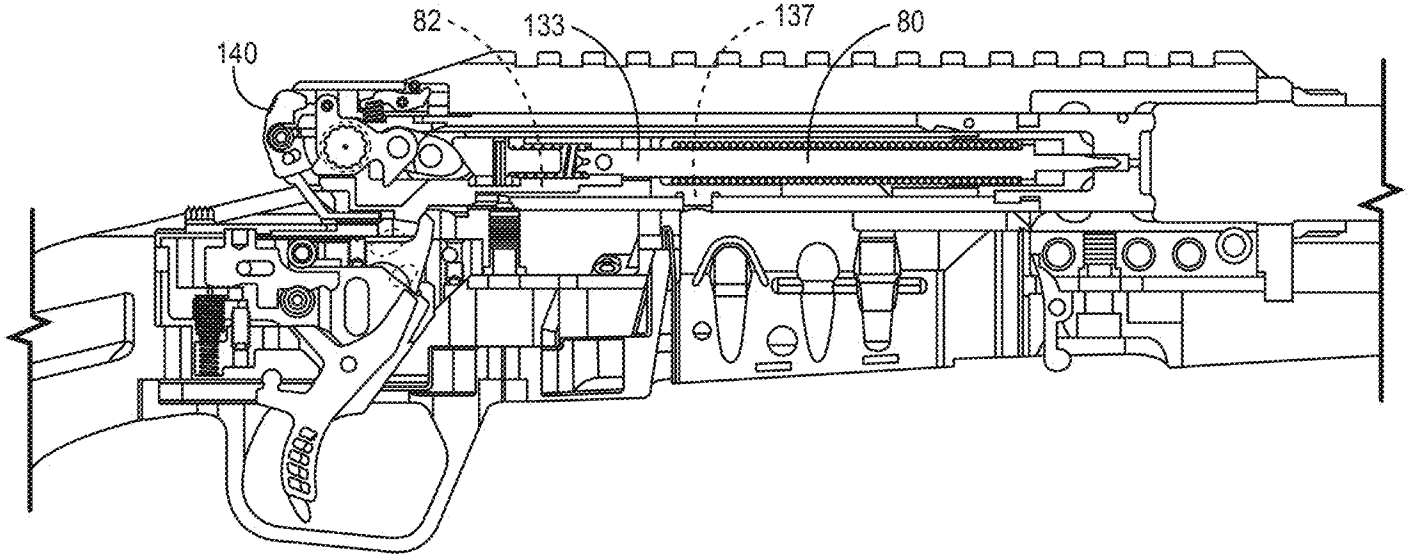
FIGS. 12A and 12B are cross sectional views of the rifle illustrating the mechanisms in an in-battery and ready-to-fire mode.
Figure 12B:
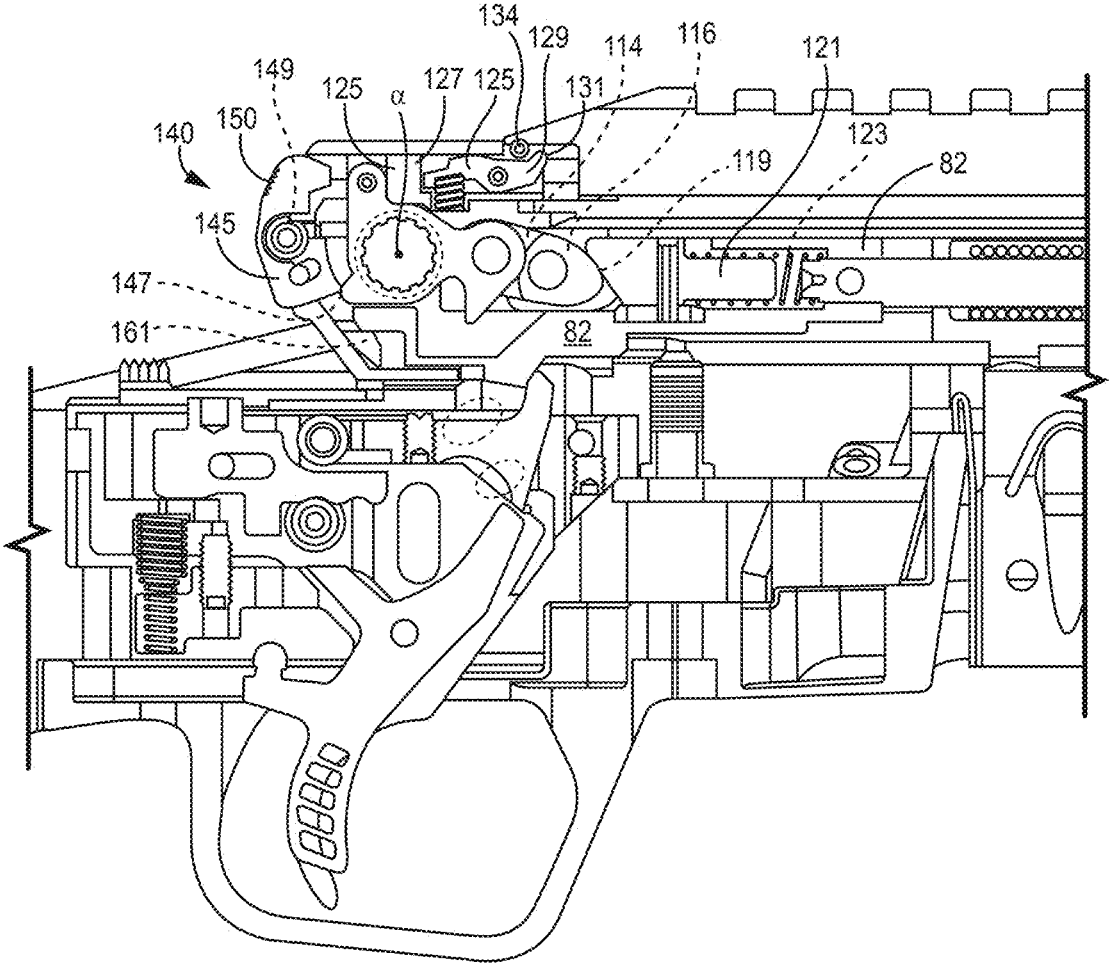
Figure 12C:
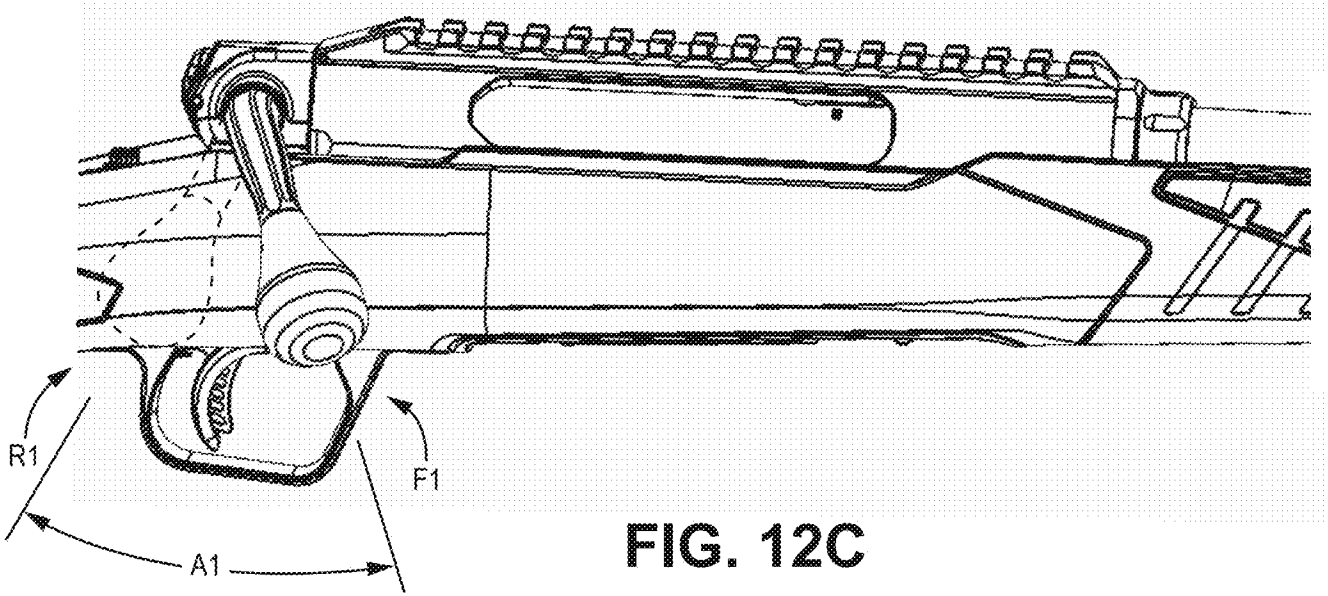
FIG. 12C is a side elevational view of the exterior of the rifle when in the in-battery and ready-to-fire mode

FIGS. 12A-C Bolt assembly in a ready-to-fire and in-battery position

Figure 13A:
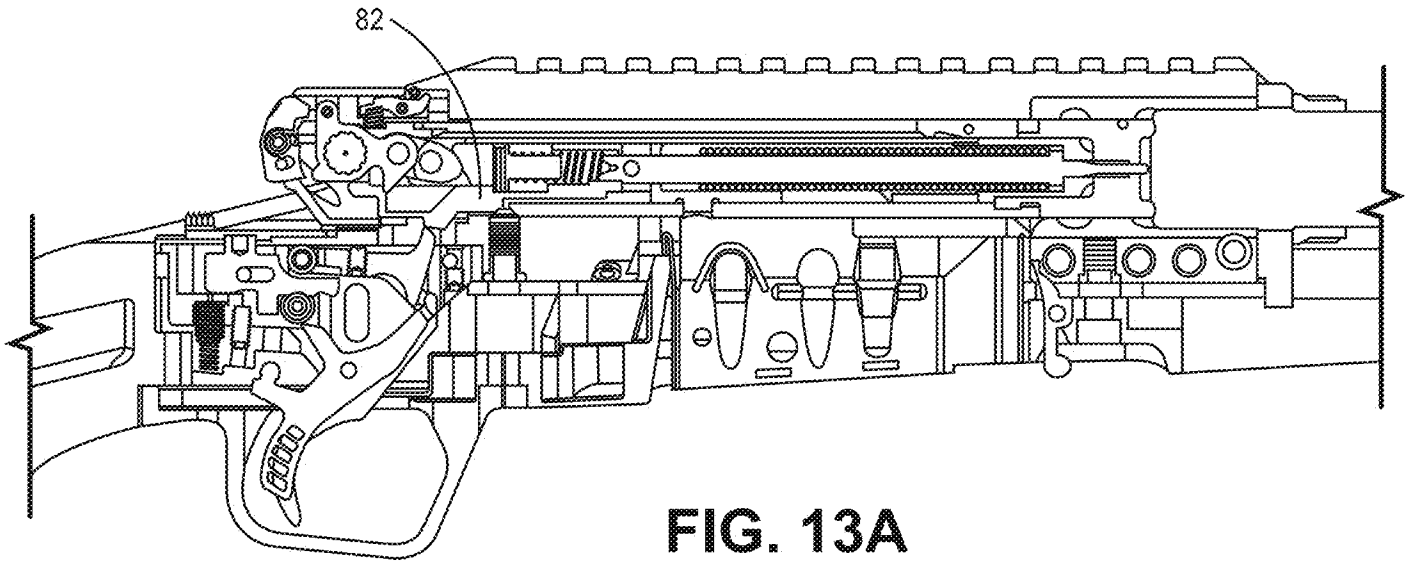
FIGS. 13A and 13B are cross sectional views of the rifle illustrating the mechanisms in a firing mode with the firing pin extended forward.
Figure 13B:
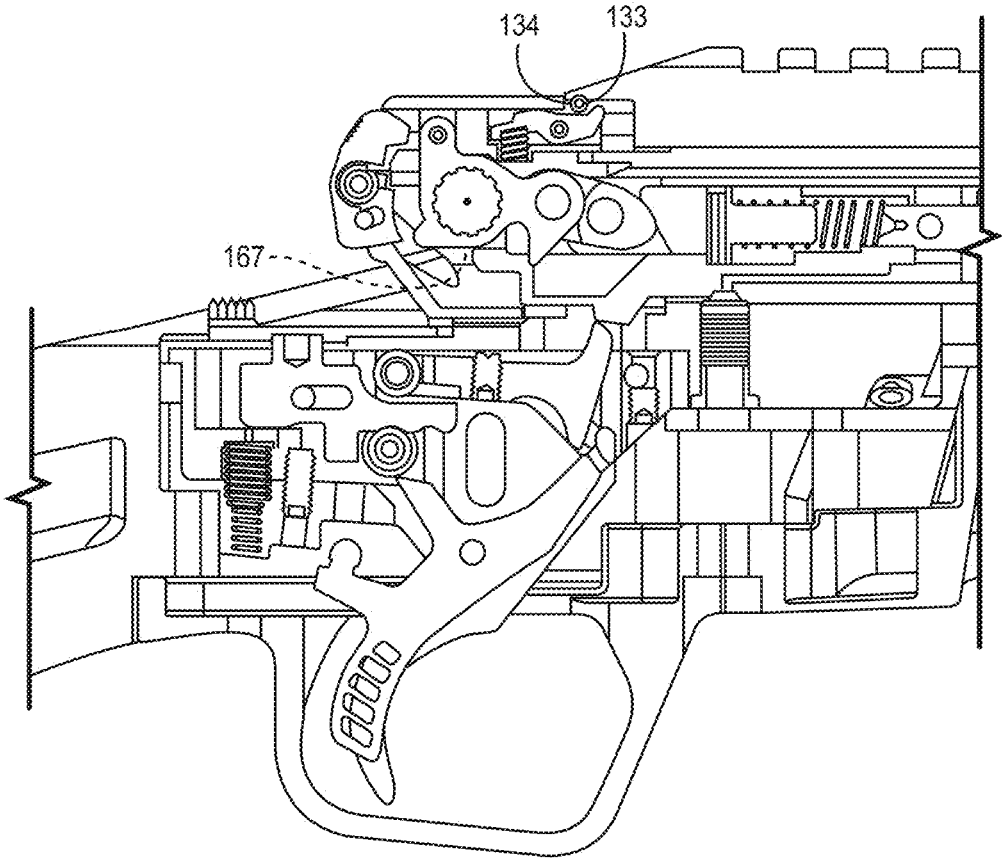
Figure 14A:
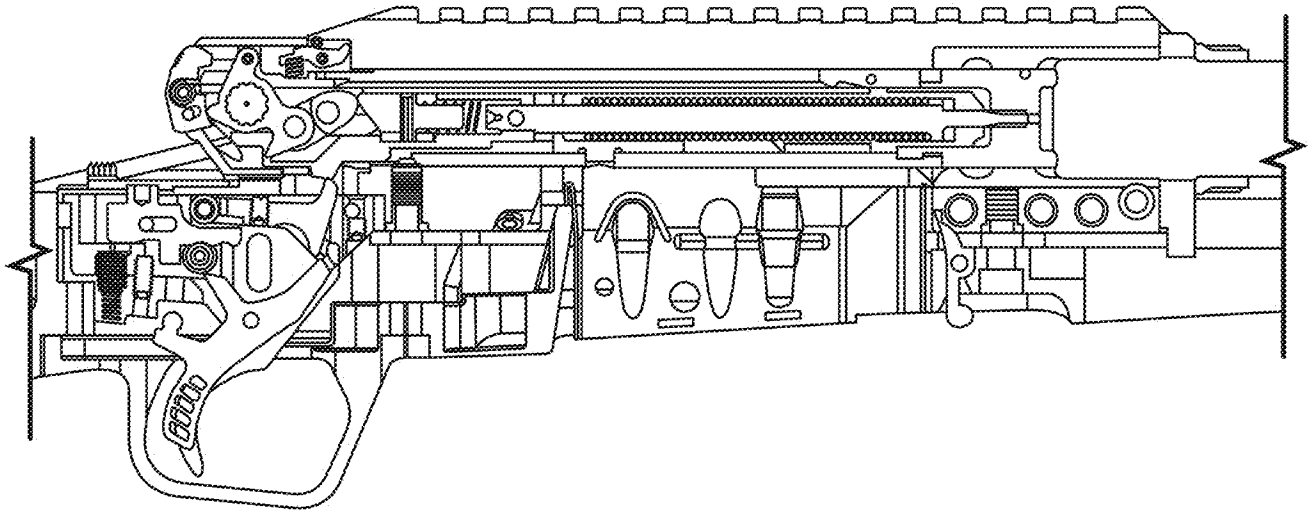
FIGS. 14A and 14B are cross sectional views of the rifle illustrating the mechanisms after firing with the bolt handle unlocked ready for extraction, the bolt head still locked in the barrel extension.
Figure 14B:
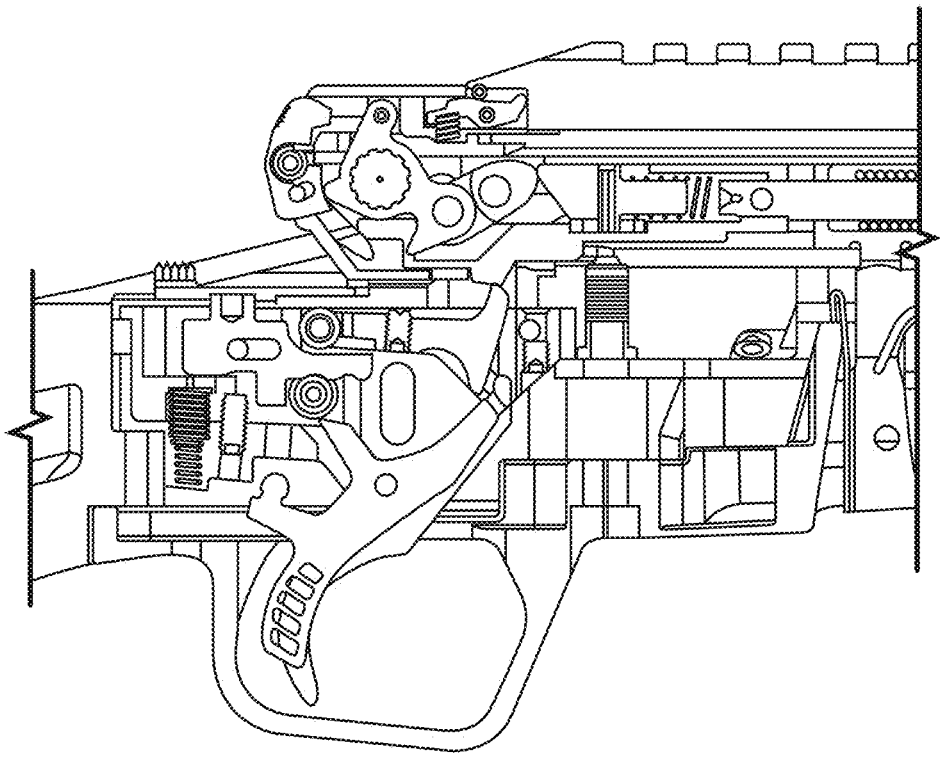
Figure 15A:
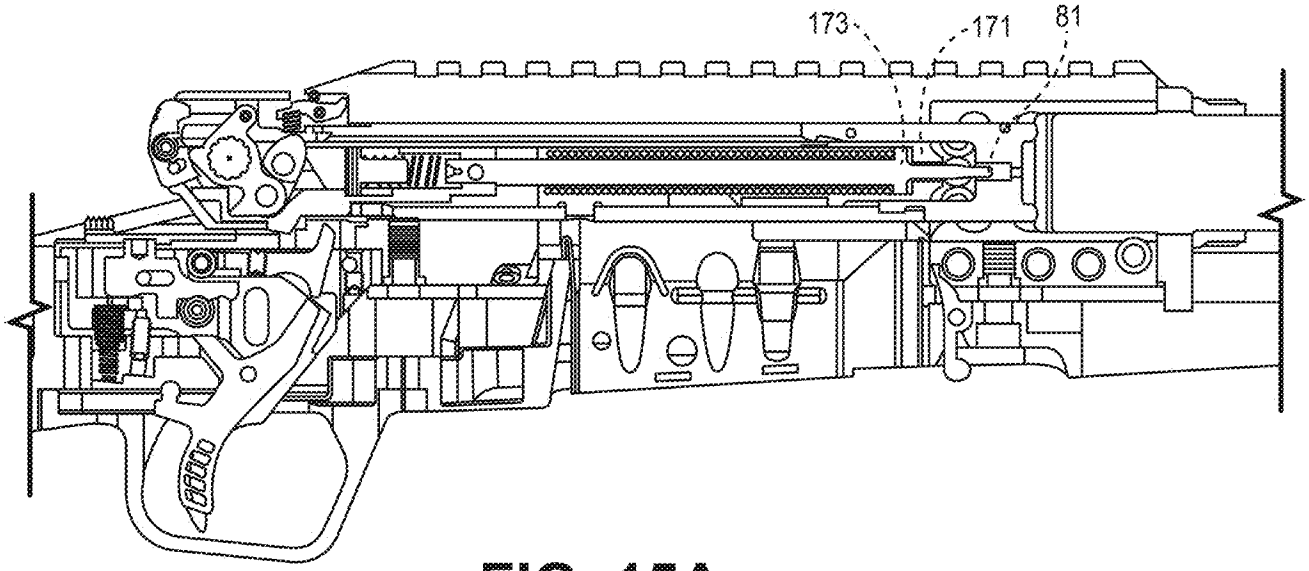
FIGS. 15A and 15B are cross sectional views of the rifle illustrating the mechanisms with the handle rotated rearwardly moving the striker rearwardly compressing the firing pin spring and with the third linkage system pushing away from the receiver.
Figure 15B:
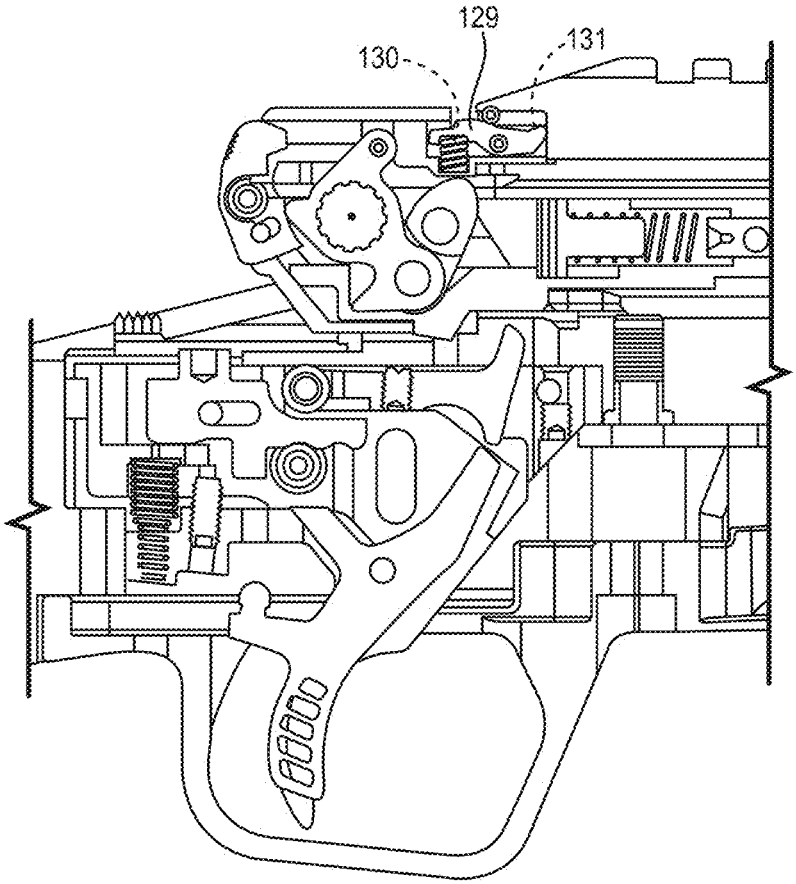
Figure 16A:
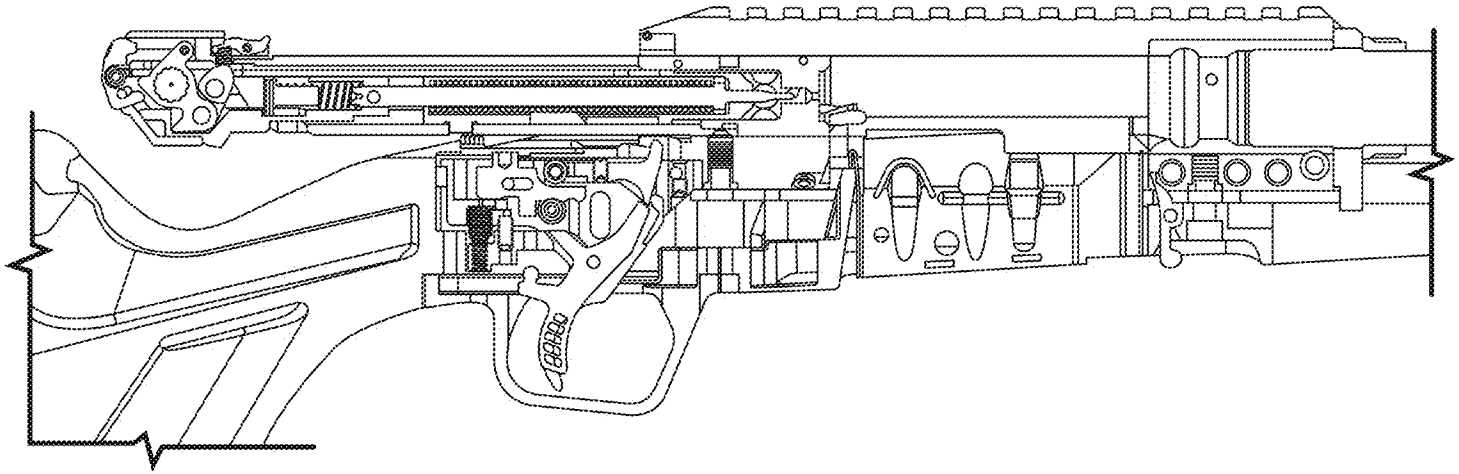
FIGS. 16A, 16B and 16C are cross sectional views of the rifle illustrating the bolt assembly pulled rearwardly.
Figure 16B:
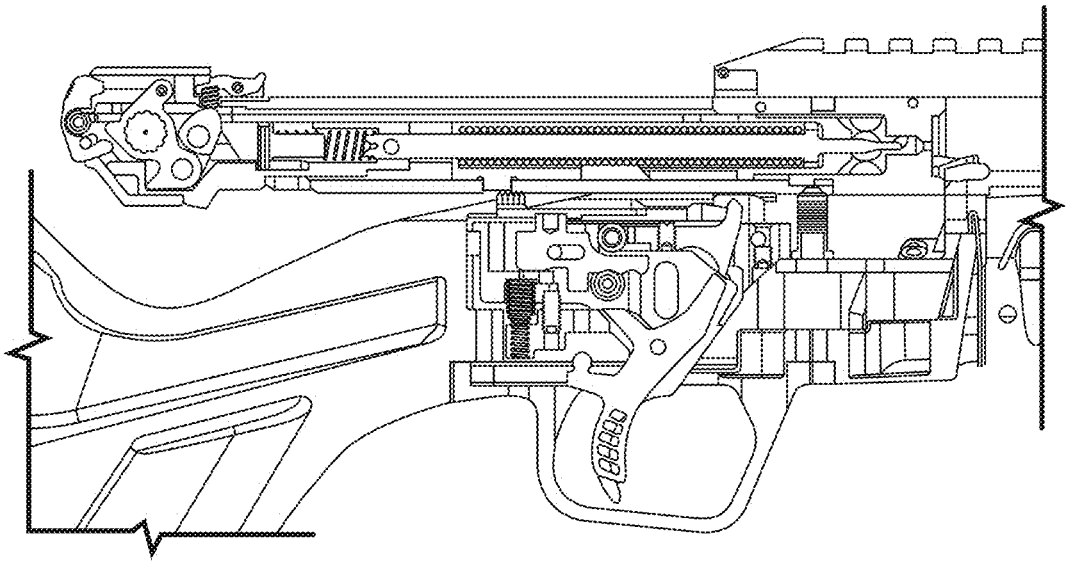
Figure 16C:
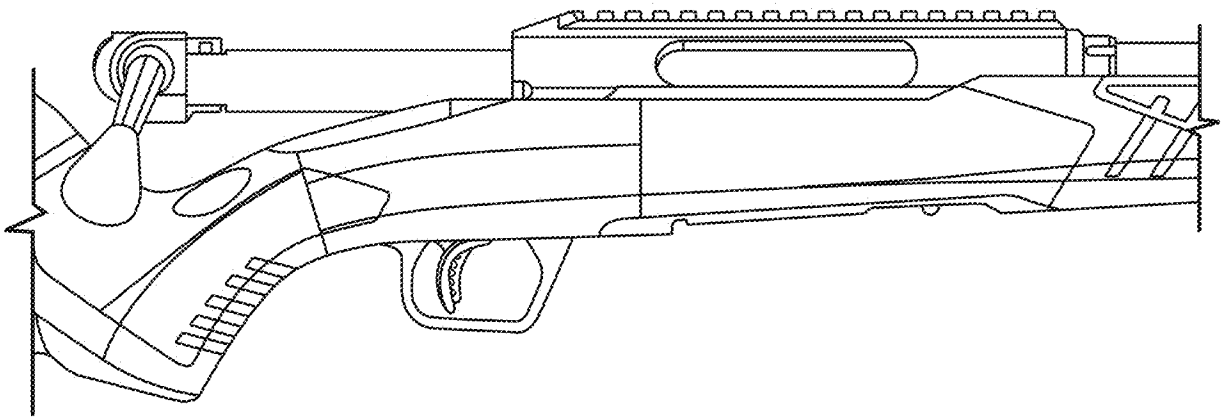
Figure 17A:
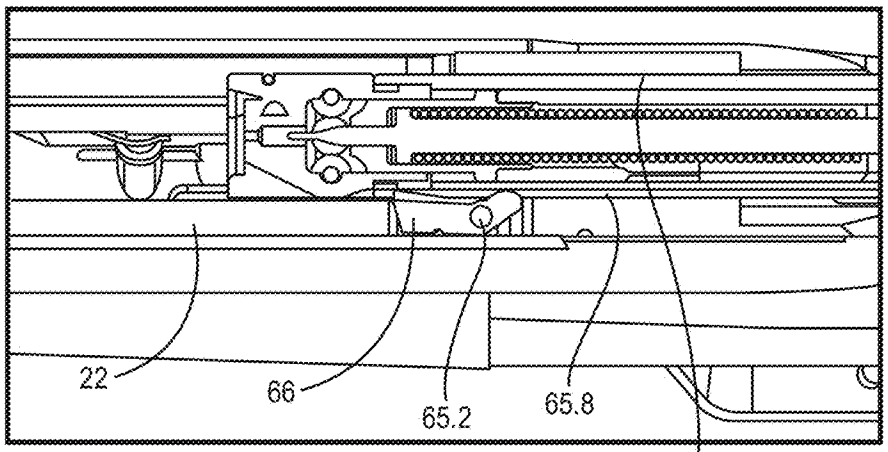
FIGS. 17A-17D are a cross sectional views of the bolt head and bolt body being retracted illustrating the ejector mechanism motion for ejection of a cartridge.
Figure 17B:
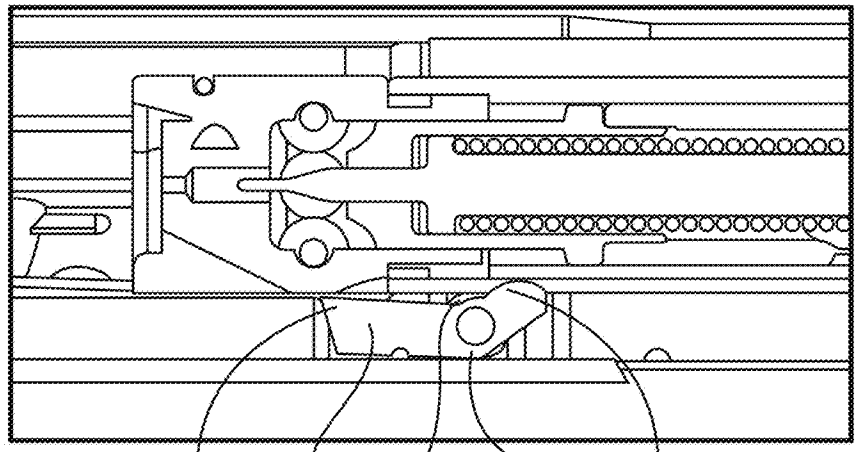
Figure 17C:
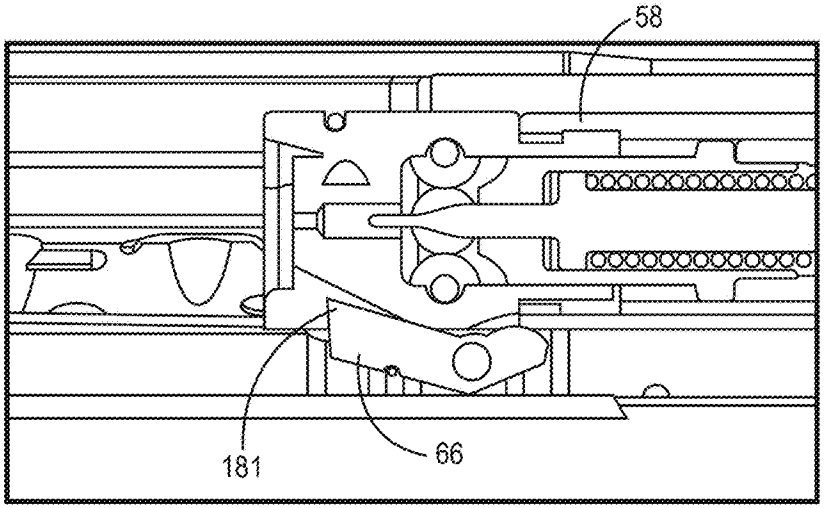
Figure 17D:
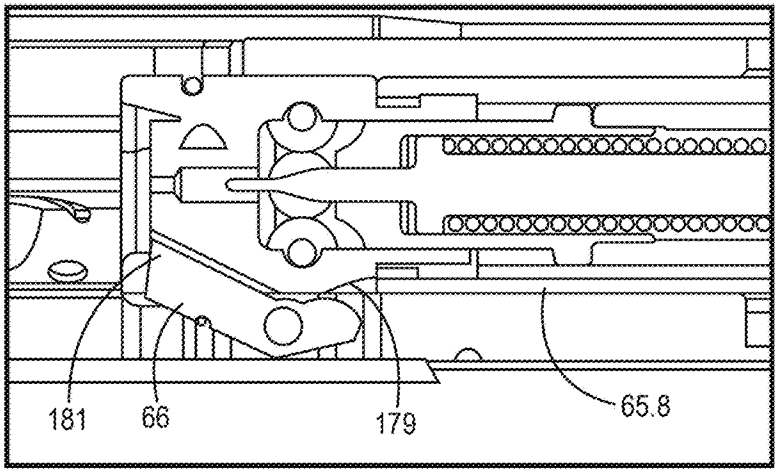

FIGS. 13A-B Trigger pulled releasing striker from sear and firing pin forward FIGS. 14A-B Rotation of bolt handle rearward commencing ejection cycle and cocking, bolt head still locked FIGS. 15A-B Further rotation of bolt handle to the rearwardmost position, the striker pulled fully rearward, bolt head released, gradual pushing off of receiver by bolt assembly FIG. 16A-C Bolt assembly pulled rearwardly to the rearwardmost position ejecting any casing or cartridge that was in the chamber The bolt handle 32 having a horizontal rotation axis at the rear bolt cap and an angular range A1 of about the axis of about 45 degrees, plus or minus 15 degrees, in embodiments, see in particular, FIGS. 12C and 16C. In embodiments the bolt handle angular range of rotational motion is 30 degrees to 90 degrees as defined by a forwardmost rotational position F1 and a rearwardmost rotational position R1. The bolt handle 32 connecting to a main rotatable drive member 100 within the mechanism enclosure 60, rotatably connecting to the bolt body 58. See FIGS. 5A-5C. The drive member 100 is connected to and initiates the four different linkage systems that providing the functionality of the bolt assembly in the rifle. Those functionalities can be described as follows: locking the bolt in the in-battery position, providing the gradual final locking of the bolt with the mechanism locking up in an over center arrangement, locking the bolt handle forwardly or rearwardly, unlocking the forward bolt handle manually or upon firing, gradually pushing off the receiver by the bolt assembly initiating the extraction phase, locking the bolt handle forwardly, and cocking the action.

Figure 9:
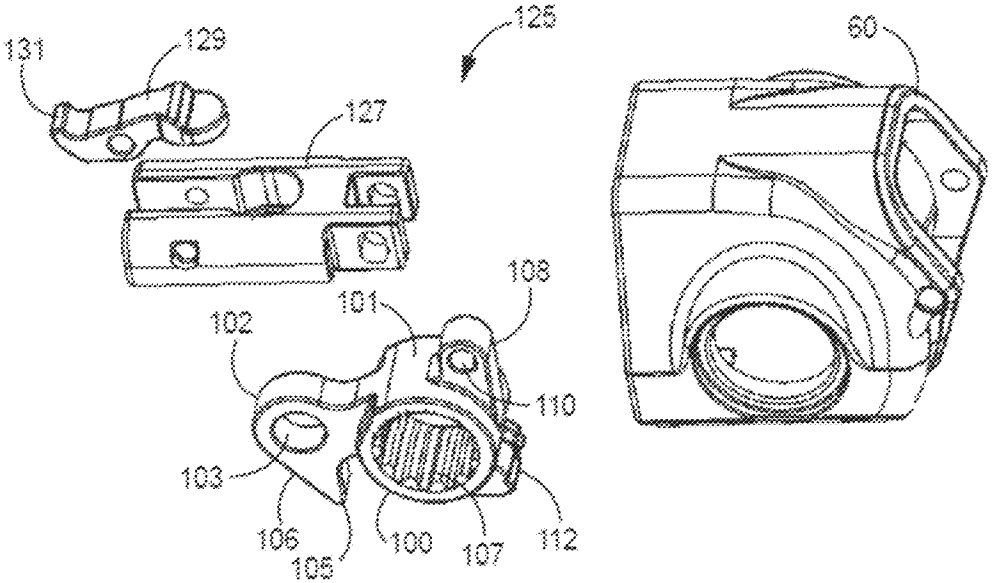
FIG. 9 is an exploded view of components of a second linkage system.
Figure 10A:
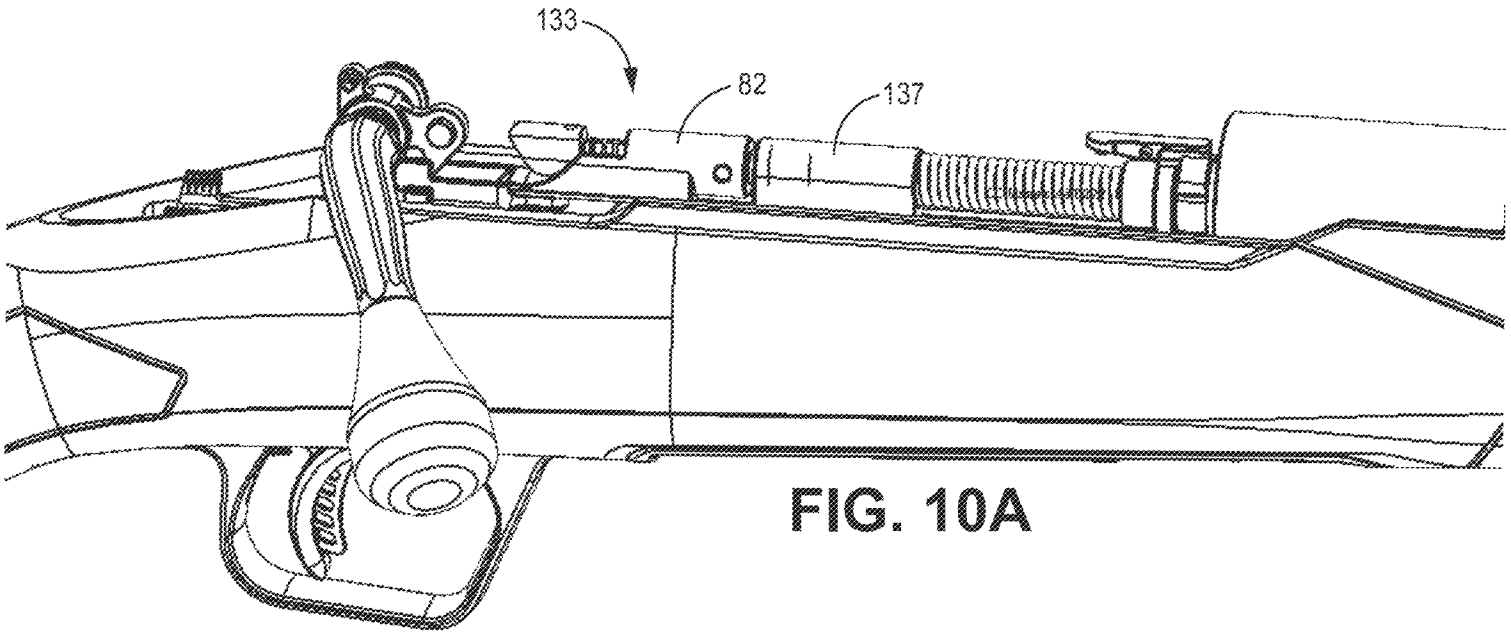
FIG. 10A is a perspective view of the rifle with portions removed illustrating components of a third linkage system.
Figure 10B:
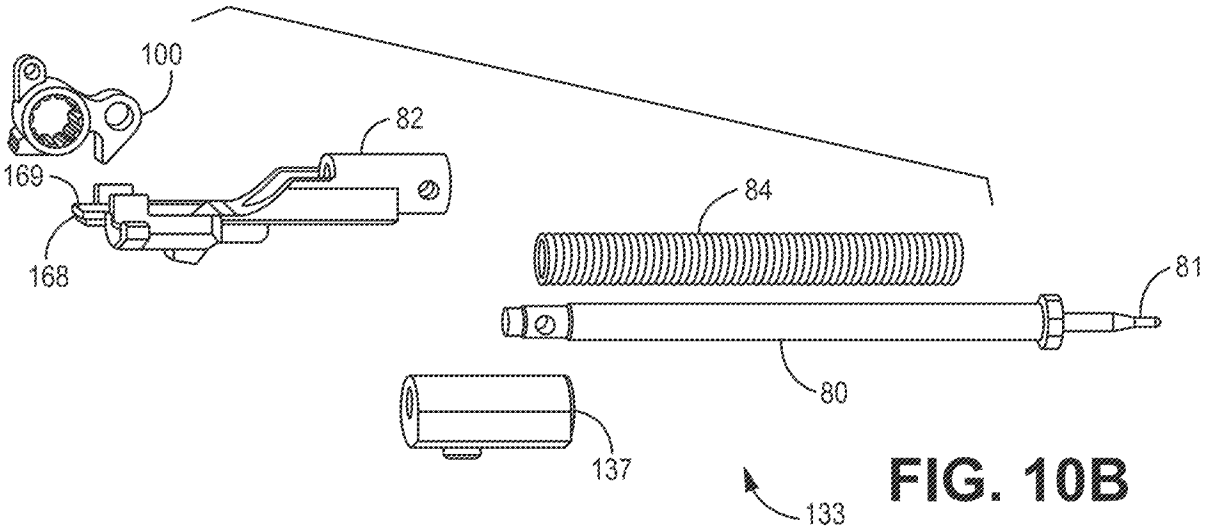
FIG. 10B is an exploded view of the components of the third linkage system.
Figure 11:
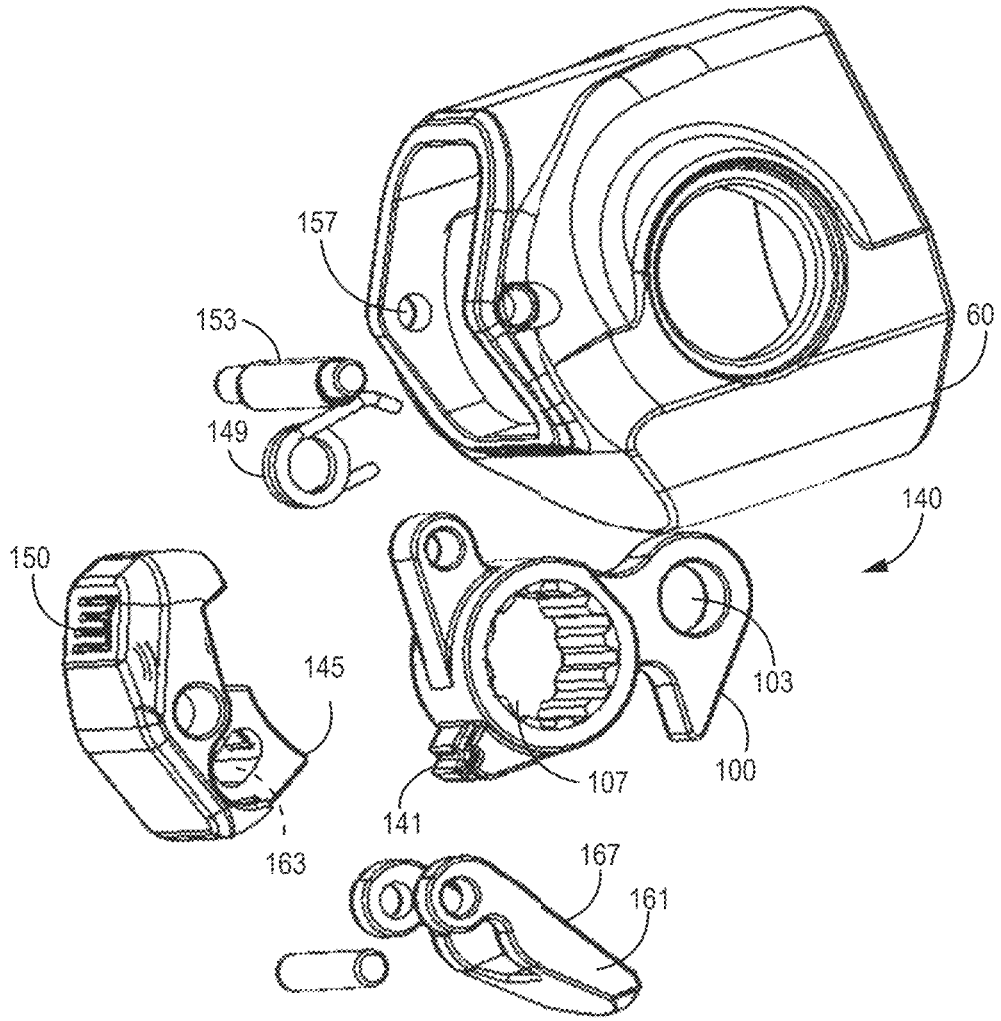
FIG. 11 is a perspective view of a fourth linkage system.

As best shown in FIG. 9, the main rotatable drive member 100 has a barrel portion 101, a first arm 102 with a pivot aperture 103, a projection 105, and a cam surface 106 all unitary with one another. Also extending outwardly from the barrel portion are a second arm 108 has a pivot aperture 110 and a bolt handle locking projection 112. The main rotatable drive member has a central opening 107 that receives the shaft portion 92 of the bolt handle 32.

Referring to FIGS. 8, 10A, 12A, 12B, components and interrelationships of a first linkage system 114 which is a sliding toggle mechanism with a first link 115 being the first arm of the main rotatable drive member 100, the second link 116 pivotally pinned to the first link and also pivotally pinned to a slider at the other end, the slider being the bolt plunger 78. The first and second links being constrained within the bolt assembly and having an over center position, see FIGS. 12A and 12B, that corresponds to the bolt plunger being extended and holding the locking roller balls into engagement with the barrel extension thereby locking the bolt head in the in-battery position. This position also correlates to the bolt handle in the forwardmost position. The second link also having cam surfaces 119 thereon that receive a bias inward toward the first link by a pusher member 121 that helps maintain the over center position of the linkage and maintains the bolt plunger as rearward as permitted by the positioning of the linkage. The pusher member slidingly engaged with the striker 82 and a spring 123 positioned between the striker and the pusher member. The first linkage system for locking and releasing the bolt in the in-battery position and providing the reduced travel rate for said locking and releasing. The first linkage system also functions to facilitate locking the bolt handle in the rearward most position, see FIGS. 15A-16C.

A second linkage system 125 is illustrated in FIG. 9 and 12A-16B and comprises the second arm 108 of the main rotatable drive member 100, an extraction plunger configured as an H-shaped connecting link 127 pivotally pinned to the second arm, and a catch link 129 with a catch portion 131 pivotally pinned to the H-shaped connecting link. In FIGS. 12A-13B, before the bolt handle 32 is rotated rearwardly, the catch portion 131 engages a catch surface 133 on a pin 134 on the receiver 22. In FIGS. 15A and B, the second linkage system 125 is pushing off the receiver by way of the extraction plunger or connecting link 127 and/or the catch link 129 commencing the ejection cycle. The catch link 129 rotating clockwise urged by the spring 130 to move the catch portion 131 out of a catch position thereby allowing the bolt assembly to be slid rearwardly.

A third linkage system 133 is illustrated best in FIGS. 10A, 10B and 12A-16B, where the cam 105 of the main rotatable drive member 100 and two links, the striker 82 and firing pin 80 compress the firing pin spring 84 in preparation for firing, utilizing rotation of the bolt handle and the connected drive member 100. The firing spring is anchored with respect to the bolt body by way of a firing spring mount 137. The rotation of the main rotatable drive member, rotatably fixed to the bolt body, provides a cam surface of projection that pushes a first link (the striker) rearwardly. See FIGS. 13A-15B, the striker pinned to the firing pin such that as the striker and firing pin are pulled rearwardly within the bolt body the firing pin spring is compressed, the firing pin spring having a rearward end anchored to the bolt body. The striker is subsequently engaged by the sear to hold the firing pin spring in the compressed state see FIGS. 12A and 12B.

A fourth linkage system 140 is illustrated best in FIGS. 11 and 12A-16C. The fourth linkage system is a catch and release mechanism for locking the handle in the forwardmost position when the bolt is in the in-battery ready-to-fire position and for providing a push button release button accessible by the thumb for releasing the bolt handle from said position. The main rotatable member 100 providing a handle lock projection 141 that engages a cooperating projection 143 on a pushbutton lever 145 at a juncture 147. See FIGS. 11 and 12B. The pushbutton lever 145 having a thumb pushbutton 150 that is pivotal by a pin 153 on the mechanism housing 60 at pin holes 157, The lever is biased in clockwise direction (as seen in FIG. 12B) by torsion spring 149. A actuation link 161 is loosely pinned to the push button lever 145 at elongate pin hole 163 having a cam follower surface 167 that is engaged by a cam surface 168 on the rearward end 169 of the striker 82 (see FIG. 10B), such that as the striker is pulled back by way of the third linkage, the push button actuation link causes a lower end of the thumb pushbutton lever to move towards the main rotatable member to catch and secure the handle lock projection 141, see FIGS. 14B and 15B, locking the rotation of the rotatable member in place, thereby locking the bolt handle in the forwardly most position of the bolt handle. When locked, pushing the thumb button 150 rotates the pushbutton lever 145 clockwise thereby breaking the juncture 147 as shown in FIG. 12B. This allows the bolt handle to be rotated rearwardly from the forwardmost position (see FIGS. 12B and 12C) thereby rotating the main rotatable drive member 100 clockwise. This then actuates the first linkage system 114 described above to pull back the bolt plunger 78 thereby releasing the bolt head 86 and moreover, putting the front nose 171 of the bolt plunger 78 in an obstructing position with the firing pin flange 173 thereby precluding the firing pin tip from reaching a cartridge, providing a bolt handle operated safety, see FIG. 15A.

Referring to FIGS. 17A-17D, the ejection cycle is shown with the bolt assembly 30 being pulled rearwardly in the receiver 22. The ejector 65 has an ejector bar 66 rides in a slot 68 in the bolt body 58 and bolt head and pivots about a post 65.2 supported by the receiver. A torsion spring 72 urges the forward ejector portion 74 toward the bolt body and keeps the ejector bar in the slot. A cam follower surface 177 on the ejector bar 66 follows the cam surface 178 defined by the slot 68 and the raised portion 179. When the cam follower surface of the ejector bar engages the raised portion, an ejector portion 181 on the forward end of the ejector bar is forced inwardly into the ejector slot on the bolt head 86. The camming action is supplemental to the inward urging of the ejector portion by the torsion spring 72.

Figure 18:
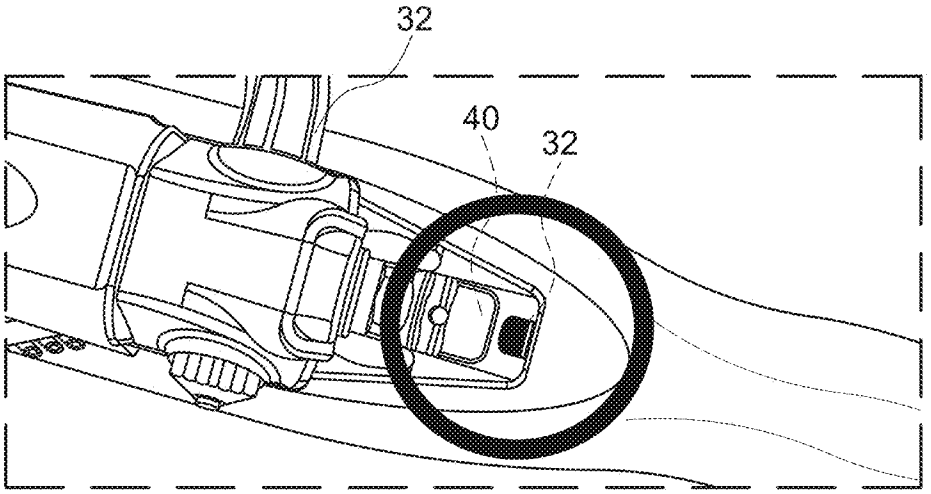
FIG. 18 is a top plan view of the rearward end of the bolt assembly of the rifle.
Figure 19:
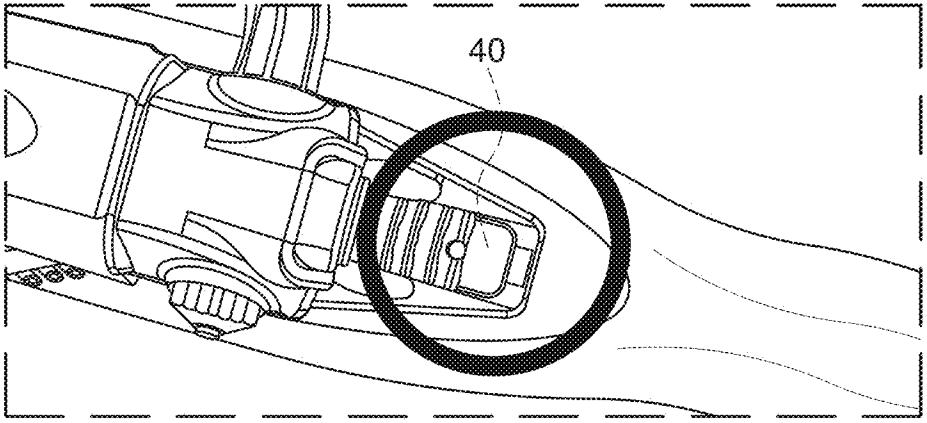
FIG. 19 is a top plan view of the rifle of FIG. 18 with the safety selector in the safe mode.

Additional operations of embodiments are described below. Referring specifically to FIGS. 18 and 19, the two position safety selector 40 is located at the rear of the receiver and can be operated with either hand. Pushing it either forward, away from the shooter, or rearward, towards the shooter, will engage or disengage the safety. Sliding the Safety Selector forward, the indicator 202 is visible and the safety is off-Ready to Fire position-see FIG. 18. Sliding the Safety Selector rearward, the Red Indicator is hidden from view and the safety is on-Full Safe position—see FIG. 19. In embodiments, the safety blocks the trigger from moving and does not lock the bolt from moving. The bolt can be opened or closed with the safety selector 40 in either position.

Figure 20:
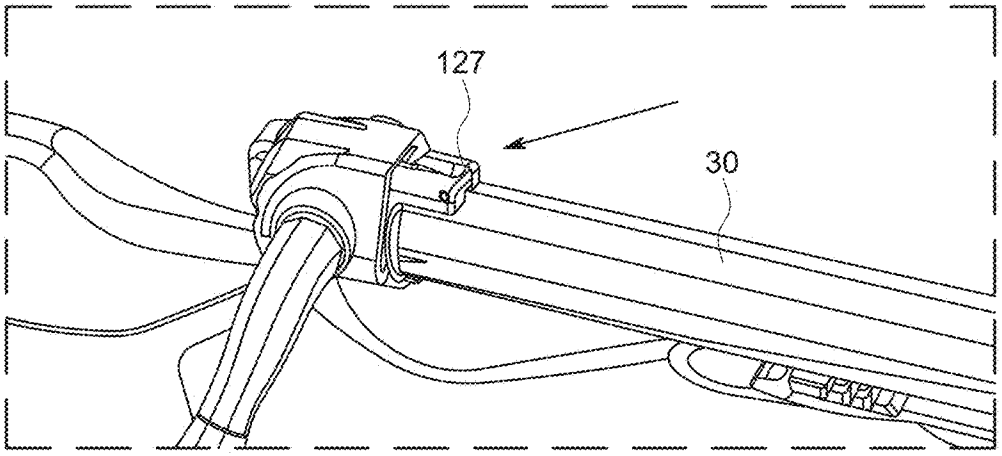
FIG. 20 is a perspective view of the rifle with the bolt assembly pulled to a rearwardmost position.
Figure 21:
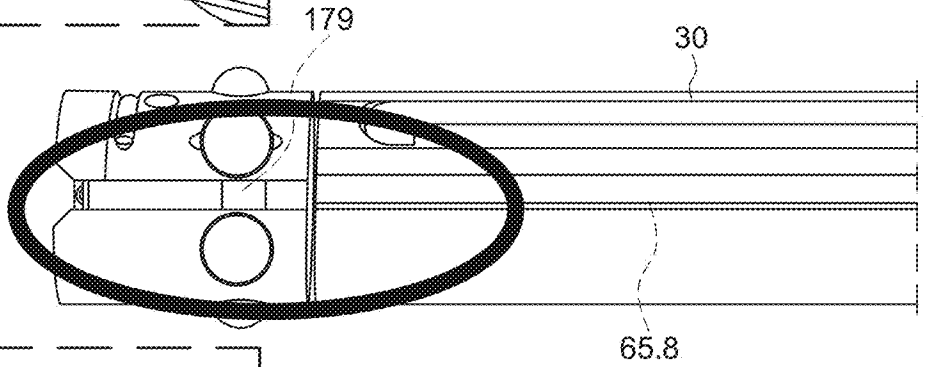
FIG. 21 is a side elevational view of a bolt assembly with a bolt head thereon.
Figure 22:
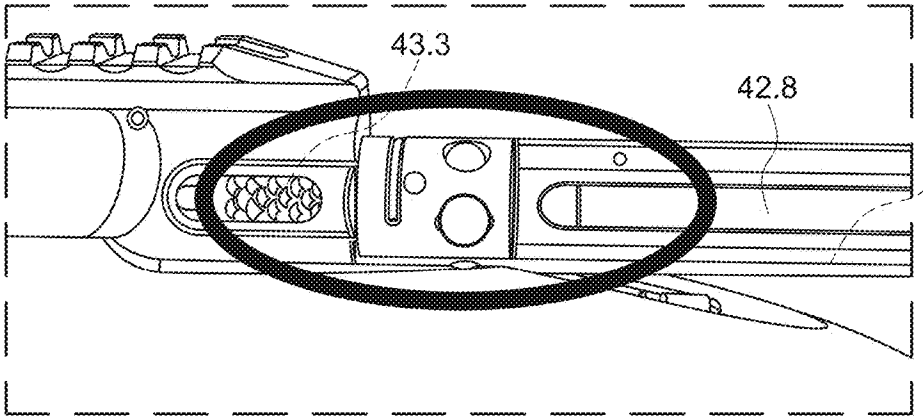
FIG. 22 is a side elevational view of the bolt assembly of FIG. 21 being inserted into a receiver.

Referring to FIGS. 20-22, the bolt may be installed as follows. For installation of the bolt, the safety selector 40 may be positioned in the position of FIG. 19, the full safety position, the bolt handle 32 assembly should be cocked with the bolt handle 32 rotated fully rearward with the extraction plunger 127 fully visible as in FIG. 20, the ejector slot 68 aligned as shown in FIG. 22. The bolt may be manipulated forward and the bolt stop release lever 43.3 will snap into the bolt stop groove 42.8.

Figure 23:
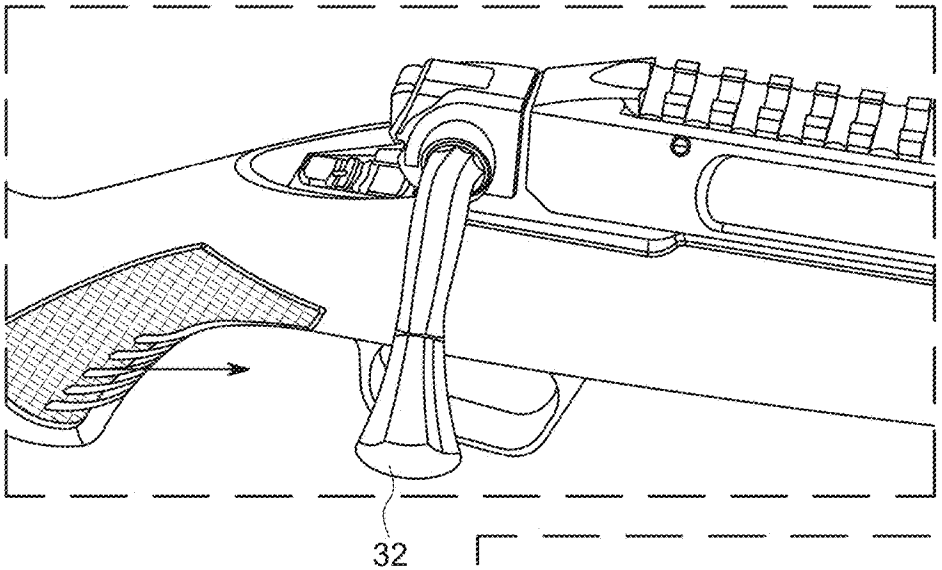
FIG. 23 is a perspective view illustration the bolt handle being pushed forward.
Figure 24:
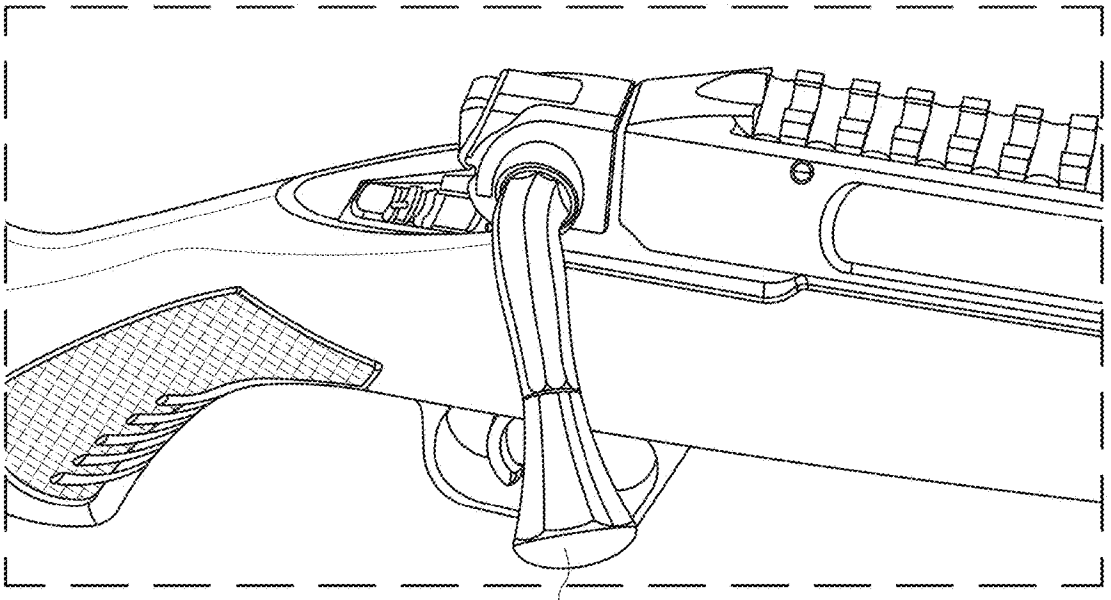
FIG. 24 is a perspective view of the rifle of FIG. 23 with the bolt handle forward.
Figure 25:
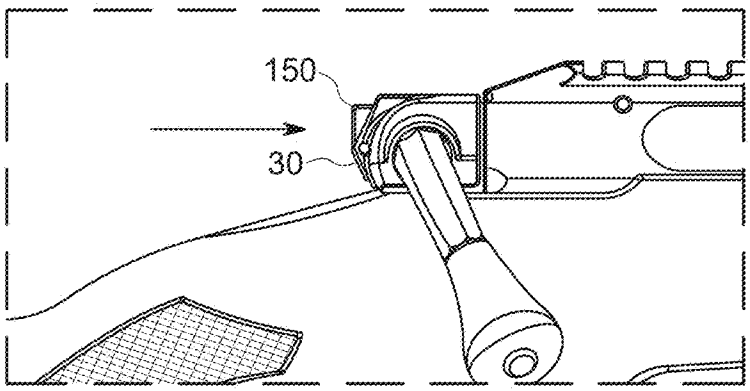
FIG. 25 is a side elevational view of a rifle with the thumb pushbutton being depressed.
Figure 26:
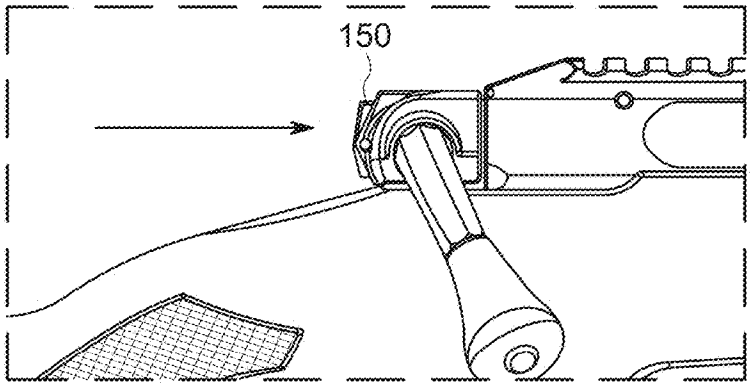
FIG. 26 is a side elevational view of the rifle of FIG. 25 after the thumb pushbutton has been depressed.
Figure 27:
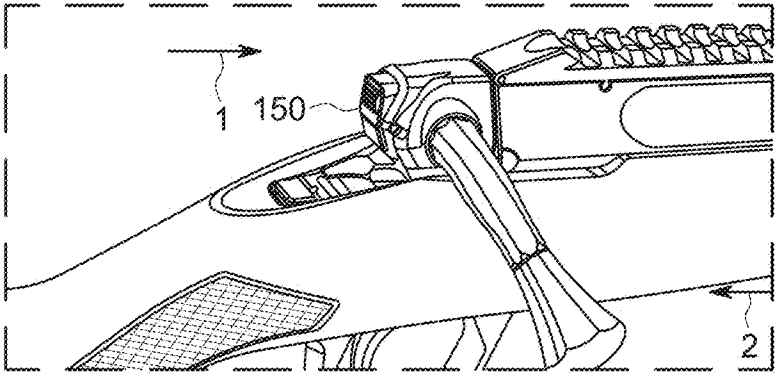
FIG. 27 is a perspective view of a rifle with the bolt handle being pushed rearwardly and the thumb pushbutton being depressed.

Referring to FIGS. 23-27, the bolt assembly 30 may be cycled as follows. With the safety selector 40 forward, and the bolt handle 32 forward as shown in FIGS. 23 and 24, the firearm is ready to fire if a cartridge is in the chamber. With the firearm cocked, the thumb pushbutton 150 is in the near vertical position as shown in FIG. 25. When the firearm has been fired the pushbutton 150 will be forward and no longer vertical as shown in FIG. 26. The pushbutton 150 is thus a cocking indicator that visually shows when the firearm is cocked or not. The pushbutton also acts as a release button, which in embodiments, will allow the bolt to be unlocked and pulled rearward if the firearm has not been fired. With the safety selector 40 rearward in the FULL SAFE position, the top of the pushbutton may be depressed, and the bolt handle pulled rearwardly.

Figure 28:
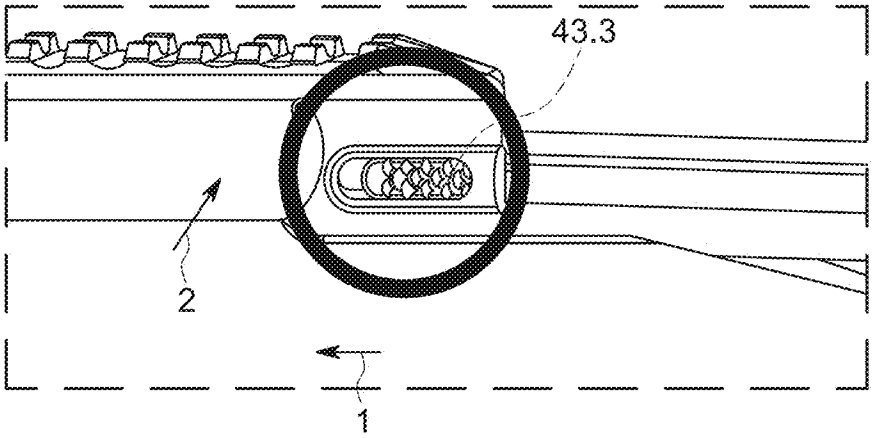
FIG. 28 is a side view of a portion of a rifle showing the motions for releasing the bolt assembly.
Figure 29:
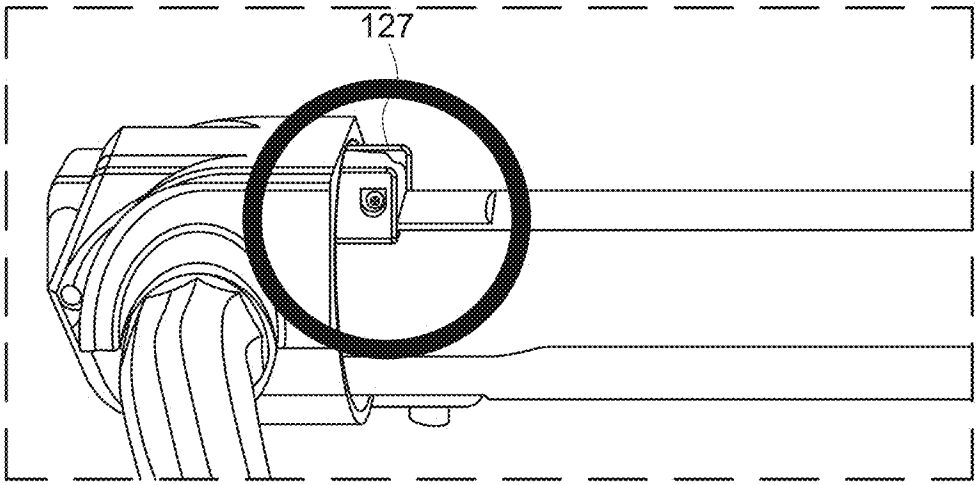
FIG. 29 is a perspective view of the rearward portion of a bolt assembly of the rifle.

Referring to FIG. 28, the bolt assembly 30 may be removed by putting the safety selector in the FULL SAFE position, with the bolt assembly 30 at its rearwardmost position, pushing the bolt stop lever forward and depressing it releases the bolt assembly and the bolt assembly may be pulled rearwardly.

Figure 5F:
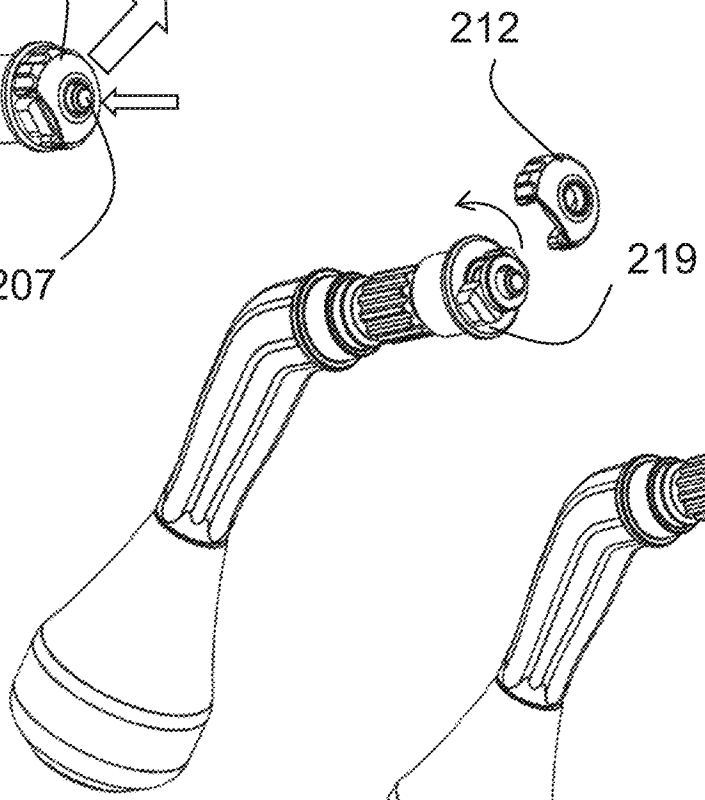
FIG. 5F is a perspective view of the bolt handle of FIG. 5E with a bolt handle cap removed.
Figure 5G:
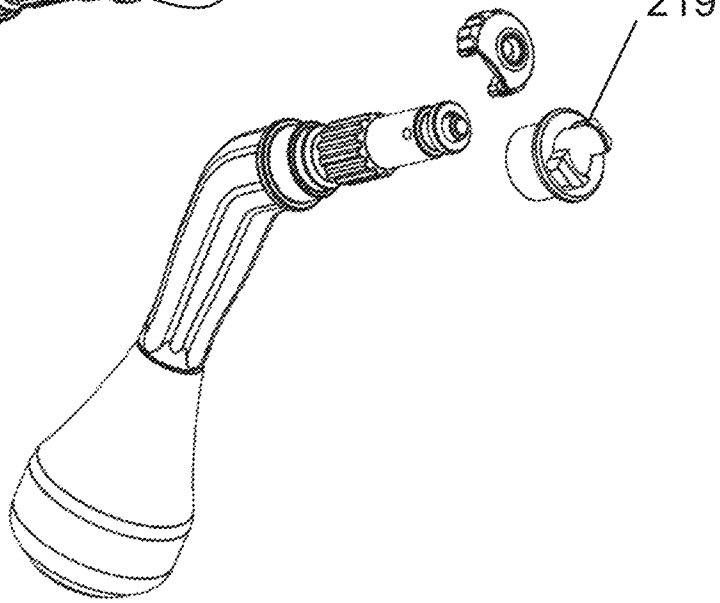
FIG. 5G is a perspective view of the bolt handle of FIGS. 5E and 5G with a bolt handle post removed.

The positioning of the bolt handle 32 may be accomplished in embodiments as follows. Referring to FIGS. 5A-5G and 29 after removing the bolt assembly 30 from the receiver 22 as described above, the bolt handle may be rotated rearwardly and then by slightly depressing the extraction plunger 127 the urges the bolt handle to slowly rotate forward, uncocking the bolt assembly. The tip 207 of plunger 209 is exposed on the end of the bolt handle shaft portion 92 centrally positioned within the bolt handle cap 212. The plunger is spring loaded by spring 214 and secured in the bolt handle shaft portion by pin 217. Depressing the tip 207 of the plunger allows the cap 212 to slide off as best illustrated by FIGS. 5F and 5G. The bolt handle post 219 may be removed by unscrewing it from the bolt handle shaft portion 92. The bolt handle 32 may then be removed from the right side of the bolt assembly 25, and either reinserted with a different angular position in the right side of the bolt assembly or it may be moved to the left side of the bolt assembly with a desired angular positioning. The bolt handle post 219 is screwed back on and the bolt handle cap 212 is slide back onto the projections on the bolt handle post 219 retained thereon by the spring loaded plunger 209.

The following United States patents are hereby incorporated by reference herein: U.S. Pat. Nos. 1,568,635, 3,257,749, 3,341,963, 3,653,140, 4,547,988, 4,672,762, 6,393,961, 9,115,941, 9,513,076, 9,599,417, 9,810,496, 10,077,957, 10,247,500. Components illustrated in the incorporated by reference references may be utilized with embodiments herein. Incorporation by reference is discussed, for example, in MPEP section 2163.07(B). The above references to U.S. patents in all sections of this application are herein incorporated by references in their entirety for all purposes.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A bolt action rifle comprising:

a stock, a receiver supported by the stock, a barrel assembly extending from the receiver, a trigger mechanism below the receiver, a bolt action above the trigger mechanism and removably contained within the receiver, wherein the bolt action comprises:

a rearward bolt operation mechanism, a bolt portion extending forwardly from the rearward bolt operation mechanism, wherein the bolt portion comprises a bolt body with an open front end for receiving a first bolt head, the first bolt head having a plurality of extendable roller balls spaced around a circumference of the first bolt head for locking the first bolt head with the bolt portion to the barrel assembly, the first bolt head replaceable with a second bolt head configured for different sized cartridges.

2. The bolt action rifle of claim 1, wherein the bolt body having a lever flush with or below an exterior surface of the bolt body, the lever having a forward projection for engaging with the first bolt head whereby depression of the lever disengages the forward projection from the bolt portion allowing removal of the first bolt head from the bolt body.

3. The bolt action rifle of claim 2, wherein the forward projection engaged with the first bolt head precludes the first bolt head from rotating.

4. The bolt action rifle of claim 1, wherein the first bolt head connects with the bolt body by insertion and a partial rotation.

5. The bolt action rifle of claim 1, wherein the rearward bolt operation mechanism comprises plunger with a tapered tip for extending the plurality of extendable roller balls outwardly for locking the first bolt head in the barrel assembly or a barrel extension.

6. The bolt action rifle of claim 5, wherein the rearward bolt operation mechanism comprises a sliding toggle linkage with an over center position, the sliding toggle linkage including a sliding link configured as the plunger.

7. The bolt action rifle of claim 1, wherein the bolt action is a straight pull bolt action.

8. A method of changing a caliber of a bolt action rifle from a first sized ammunition to a second sized ammunition, the bolt action rifle having a stock, a receiver, a first barrel assembly, a bolt action assembly, wherein the method comprises:

removing the bolt action assembly from the receiver and removing a first bolt head from a bolt body of the bolt action assembly, the first bolt head having a plurality of extendable roller balls spaced around a circumference for locking the first bolt head to the first barrel assembly;

removing the first barrel assembly from the receiver;

inserting a second bolt head corresponding to the second sized ammunition into the bolt body and securing it thereto, reinstalling the bolt action assembly into the receiver; and installing a second barrel assembly to the receiver.

9. The method of claim 8, wherein removing the first bolt head from the bolt body comprises releasing a latch securing the first bolt head to the bolt body.

10. The method of claim 8, further comprising removing from the stock the receiver with the bolt action assembly therein, and removing the bolt action assembly from the receiver.

11. The method of claim 8, wherein the bolt action assembly is a straight pull bolt action assembly.

12. A straight pull bolt action rifle comprising a receiver and a barrel extending forward from the receiver, a straight pull bolt assembly seated in the receiver, the straight pull bolt assembly comprising a bolt handle that extends laterally, downwardly, and forwardly and is rotatable in an arc of a circle about an axis, the bolt handle rotatable forwardly and rearwardly for locking and unlocking a bolt portion with a bolt head having a plurality of extendable roller balls spaced around a circumference of the bolt head for locking the bolt head with the bolt portion to the barrel in an in battery position, the bolt portion slidable in a rearward direction along a barrel axis for opening accessing a firing chamber and ejecting a cartridge and slidable in a forward direction along the barrel axis for loading a cartridge and moving the bolt head toward the in battery position, wherein a tangent of the circle is parallel to the barrel axis, wherein the bolt handle is removable and replaceable to extend laterally from either of two sides of the receiver.

13. The straight pull bolt action rifle of claim 12, wherein the bolt head is replaceable with alternate bolt heads for different ammunition, and wherein the barrel is replaceable with alternate barrels for the different ammunition.

14. The straight pull bolt action rifle of claim 13, wherein the bolt portion has a bolt body having a lever flush with or below an exterior surface of the bolt body, the lever having a forward projection for engaging with the bolt head whereby depression of the lever disengages the forward projection from the bolt portion allowing removal of the bolt head from the bolt body.

15. The straight pull bolt action rifle of claim 14, wherein the forward projection engaged with the bolt head precludes the bolt head from rotating.

16. The straight pull bolt action rifle of claim 14, wherein the bolt head connects with the bolt body by insertion and a partial rotation.

17. The straight pull bolt action rifle of claim 14, further comprising a plunger positioned in the bolt body for extending the plurality of extendable roller balls outwardly for locking the bolt head in the barrel.

* * * * *